US009207561B2

(12) United States Patent
Yamada et al.

(10) Patent No.: US 9,207,561 B2
(45) Date of Patent: Dec. 8, 2015

(54) IMAGE FORMING APPARATUS FOR CONTROLLING MISALIGNMENT IN IMAGE FORMING POSITION BETWEEN COLORS

(71) Applicant: KONICA MINOLTA, INC., Chiyoda-ku (JP)

(72) Inventors: Yohei Yamada, Toyokawa (JP); Tatsuya Eguchi, Toyohashi (JP); Akimasa Ishikawa, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 14/490,044

(22) Filed: Sep. 18, 2014

(65) Prior Publication Data

US 2015/0077496 A1 Mar. 19, 2015

(30) Foreign Application Priority Data

Sep. 19, 2013 (JP) ..... 2013-194031

(51) Int. Cl.
*B41J 2/455* (2006.01)
*B41J 2/385* (2006.01)
*G03G 15/043* (2006.01)

(52) U.S. Cl.
CPC ..... *G03G 15/043* (2013.01)

(58) Field of Classification Search
CPC ..... G03G 15/043
USPC ..... 347/118, 233; 358/3.26, 510; 399/128
See application file for complete search history.

(56) References Cited

U.S. PATENT DOCUMENTS

| | | | | |
|---|---|---|---|---|
| 6,246,463 | B1 | 6/2001 | Hamada et al. | |
| 2002/0141001 | A1 | 10/2002 | Hirasawa | |
| 2003/0001686 | A1 | 1/2003 | Sekiya | |
| 2010/0253981 | A1 * | 10/2010 | Higashiyama et al. | 358/3.26 |
| 2011/0199657 | A1 * | 8/2011 | Ishida et al. | 358/510 |
| 2013/0004204 | A1 * | 1/2013 | Hagiwara et al. | 399/128 |

FOREIGN PATENT DOCUMENTS

| | | | |
|---|---|---|---|
| JP | H03-42688 | A | 2/1991 |
| JP | H06-175449 | A | 6/1994 |

(Continued)

OTHER PUBLICATIONS

Notification of Reasons for Refusal dated Aug. 4, 2015 issued in the corresponding Japanese Patent Application 2013-194031 and English translation (4 pages).

*Primary Examiner* — Julian Huffman
*Assistant Examiner* — Carlos A Martinez
(74) *Attorney, Agent, or Firm* — Buchanan Ingersoll & Rooney PC

(57) ABSTRACT

An image forming apparatus that forms a color image by layering toner images of different colors includes: a photoreceptor on which an electrostatic latent image is formed through charging and exposure; an exposure unit performing exposure-scanning on the photoreceptor in accordance with image signal; an intensity determination unit determining exposure intensity according to image forming condition; and a timing determination unit determining a timing of inputting image signal for each scanning line, wherein the exposure unit has a delay duration differing depending on the exposure intensity and being from input of image signal of each pixel to be exposed to exposure of the pixel at the exposure intensity, and the timing determination unit obtains the delay duration corresponding to the exposure intensity, and determines the timing such that image signal of an initial pixel to be initially exposed is input the delay duration before the initial pixel is exposed.

7 Claims, 19 Drawing Sheets

(56) References Cited

FOREIGN PATENT DOCUMENTS

| | | | |
|---|---|---|---|
| JP | H11-326799 | A | 11/1999 |
| JP | 2002-154236 | A | 5/2002 |
| JP | 2002-292933 | A | 10/2002 |
| JP | 2003-011410 | A | 1/2003 |
| JP | 2007-168332 | A | 7/2007 |
| JP | 2011-167898 | A | 9/2011 |
| JP | 2011-235578 | A | 11/2011 |
| JP | 2012-022196 | A | 2/2012 |

* cited by examiner

FIG. 4

| Exposure intensity | | Emission delay duration (t) | Counter CY2 |
|---|---|---|---|
| P1 | P10 | dy0 | c0 |
| | P11 | dy1 | c1 |
| | P12 | dy2 | c2 |
| | . | . | . |
| | . | . | . |
| | . | . | . |
| | P1n | dyn | cn |
| P2 | P20 | dm0 | c0 |
| | P21 | dm1 | c1 |
| | P22 | dm2 | c2 |
| | . | . | . |
| | . | . | . |
| | . | . | . |
| | P2n | dmn | cn |
| P3 | P30 | dc0 | c0 |
| | P31 | dc1 | c1 |
| | P32 | dc2 | c2 |
| | . | . | . |
| | . | . | . |
| | . | . | . |
| | P3n | dcn | cn |
| . | | . | . |
| . | | . | . |
| . | | . | . |

FIG. 5

| Emission delay duration (t) | Output delay duration ($\alpha$-t) | Select signal |
|---|---|---|
| A1 ≤ t < A2 | T16 | S16 |
| A2 ≤ t < A3 | T15 | S15 |
| A3 ≤ t < A4 | T14 | S14 |
| A4 ≤ t < A5 | T13 | S13 |
| A5 ≤ t < A6 | T12 | S12 |
| A6 ≤ t < A7 | T11 | S11 |
| A7 ≤ t < A8 | T10 | S10 |
| A8 ≤ t < A9 | T9 | S9 |
| A9 ≤ t < A10 | T8 | S8 |
| A10 ≤ t < A11 | T7 | S7 |
| A11 ≤ t < A12 | T6 | S6 |
| A12 ≤ t < A13 | T5 | S5 |
| A13 ≤ t < A14 | T4 | S4 |
| A14 ≤ t < A15 | T3 | S3 |
| A15 ≤ t < A16 | T2 | S2 |
| A16 ≤ t < A17 | T1 | S1 |

FIG. 6

| Emission delay duration (t) | Select signal |
|---|---|
| $A1 \leq t < A2$ | S17 |
| $A2 \leq t < A3$ | S18 |
| $A3 \leq t < A4$ | S19 |
| $A4 \leq t < A5$ | S20 |
| $A5 \leq t < A6$ | S21 |
| $A6 \leq t < A7$ | S22 |
| $A7 \leq t < A8$ | S23 |
| $A8 \leq t < A9$ | S24 |
| $A9 \leq t < A10$ | S25 |
| $A10 \leq t < A11$ | S26 |
| $A11 \leq t < A12$ | S27 |
| $A12 \leq t < A13$ | S28 |
| $A13 \leq t < A14$ | S29 |
| $A14 \leq t < A15$ | S30 |
| $A15 \leq t < A16$ | S31 |
| $A16 \leq t < A17$ | S32 |

IMAGE FORMING APPARATUS FOR CONTROLLING MISALIGNMENT IN IMAGE FORMING POSITION BETWEEN COLORS

CROSS-REFERENCE TO RELATED APPLICATIONS

This application is based on application No. 2013-194031 filed in Japan, the contents of which are hereby incorporated by reference.

BACKGROUND OF THE INVENTION (1) Field of the Invention

The present invention relates to image forming apparatuses such as printers and copiers, and particularly relates to an art of controlling misalignment in image forming start position between colors that occurs in image forming apparatuses for forming a color image by layering toner images of the colors.

(2) Description of the Related Art

In recent years, image forming apparatuses employing an electronic photography system use a semiconductor laser as a light source for writing onto an image carrying surface of an image carrier such as a photoreceptor. The image forming apparatuses perform exposure-scanning on the image carrying surface by laser light emitted from the semiconductor laser to form an electrostatic latent image on the image carrying surface.

Exposure-scanning is performed by turning on and off emission from the semiconductor laser based on image data. Specifically, on-off control of emission from the semiconductor laser is performed by inputting an image signal that is a pulse signal. The pulse signal is generated based on the image data, and instructs to turn on and off emission and an emission duration from the semiconductor laser.

When the image signal instructs emission from the semiconductor laser (turn-on of emission), driving current is supplied to the semiconductor laser from a laser driving device for a duration corresponding to a pulse width of the image signal.

FIG. 21 is a timing chart showing a correspondence relationship among an image signal input to a laser driving device, driving current supplied to a semiconductor laser in accordance with the input image signal, and output of laser light emitted from the semiconductor laser in accordance with the supplied driving current. In FIG. 21, section (a) indicates the image signal input to the laser driving device, section (b) indicates the driving current supplied to the semiconductor laser in accordance with the input image signal, and section (c) indicates output of the laser light emitted from the semiconductor laser in accordance with the supplied driving current.

Here, the image signal in the low status instructs turn-on of emission from the semiconductor laser. The image signal in the high status instructs turn-off of emission from the semiconductor laser. The image signal instructs an emission duration of the semiconductor laser depending on a pulse width thereof. Also, while the image signal is in the low status, the driving current is supplied to the semiconductor laser. While the image signal is in the high status, the driving current is not supplied to the semiconductor laser. Furthermore, while the image signal is in the low status, laser light is output. While the image signal is in the high status, laser light is not output.

As shown in the figure, supply of the driving current to the semiconductor laser is started in accordance with input of the image signal instructing emission from the semiconductor laser to the laser driving device. However, output of laser light is delayed behind input of the image signal instructing emission.

This is because after the image signal instructing emission from the semiconductor laser is input and supply of the driving current to the semiconductor laser is started, a predetermined duration is necessary for the semiconductor laser to generate a carrier having a concentration at which laser oscillation is possible.

As a result, an actual emission duration of laser light is shorter than the emission duration from the semiconductor laser which is instructed by the image signal by a duration corresponding to output delay of the laser light. In response to this problem, for example, Patent Literature 1 (Japanese Patent Application Publication No. 2011-167898) discloses an art of expanding a pulse width of an image signal (equivalent to a light emitting signal in Patent Literature 1) to reserve an emission duration corresponding to the image signal.

According to this art, the pulse width of the image signal is expanded by a pulse width corresponding to the output delay, and as a result the emission duration is extended. Therefore, it is possible to adjust the emission duration of the laser light so as to correspond to the image signal.

However, the above art cannot adjust start delay of emission of laser light that is caused by an emission delay duration from when the image signal instructs emission from the semiconductor laser to when the semiconductor laser emits laser light. Also, as disclosed in Patent Literature 2 (Japanese Patent Application Publication No. 2011-235578), the emission delay duration varies depending on an amount of laser light emitted from the semiconductor laser (exposure intensity) and so on (the emission delay duration decreases as the amount of laser light increases).

For this reason, in the case where image forming apparatuses, which perform image formation by layering images of four colors of yellow, magenta, cyan, and black, such as full-color image forming apparatuses, use a different exposure intensity of a semiconductor laser for each color, an emission delay duration also differs for each color. This causes misalignment in writing start position in a scanning direction for exposure-scanning between the colors, and as a result causes color misregistration due to the misalignment in image forming start position in the scanning direction between the colors.

SUMMARY OF THE INVENTION

In order to solve the above problem, the present invention provides an image forming apparatus that forms a color image by layering toner images of different colors, the image forming apparatus comprising: a photoreceptor on which an electrostatic latent image is formed through charging and exposure; an exposure unit that performs exposure-scanning on a surface of the photoreceptor in accordance with an image signal input thereto; an intensity determination unit that determines exposure intensity of the exposure unit according to an image forming condition; and a timing determination unit that determines an input timing at which an image signal is to be input to the exposure unit for each scanning line, wherein the exposure unit has a delay duration that differs depending on the exposure intensity, the delay duration being a duration from input of an image signal of each pixel to be exposed in each scanning line on the surface of the photoreceptor to start of exposure of the pixel at the determined exposure intensity, and the timing determination unit obtains the delay duration corresponding to the determined exposure intensity, and determines the input timing such that an image signal of an initial pixel to be initially exposed in each scanning line on the surface of the photoreceptor is input the delay duration before exposure of the initial pixel is started.

BRIEF DESCRIPTION OF THE DRAWING

These and other objects, advantages and features of the invention will become apparent from the following description thereof taken in conjunction with the accompanying drawings those illustrate a specific embodiments of the invention.

In the drawings:

FIG. 4 shows a specific example of an emission delay duration specification table;

FIG. 5 shows a specific example of a position correction amount selection table;

FIG. 6 shows a specific example of a width correction amount selection table;

DESCRIPTION OF PREFERRED EMBODIMENTS

The following describes an embodiment of an image forming apparatus relating to one aspect of the present invention, by way of a tandem-type digital color printer (hereinafter, referred to simply as printer).

[1] Structure of Printer

Figure 1:
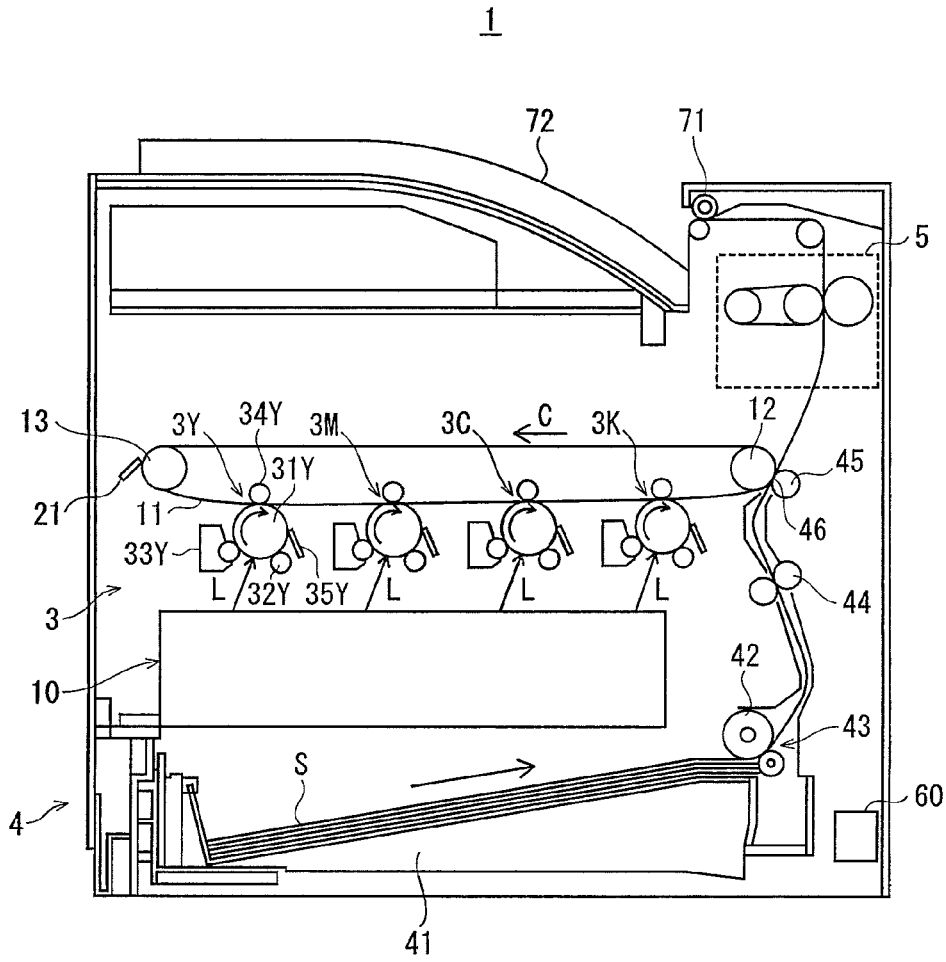
FIG. 1 shows a structure of a printer 1.

The following describes a structure of a printer 1 relating to the present embodiment. FIG. 1 shows the structure of the printer 1 relating to the present embodiment. As shown in the figure, the printer 1 includes an image process unit 3, a sheet feeding unit 4, a fixing device 5, a control unit 60, and so on.

The printer 1 is connected to a network such as an LAN (Local Area Network) to receive an instruction to start an image forming operation from an external terminal device which is not illustrated or from an operation panel which is not illustrated. Upon receipt of such an instruction, the printer 1 forms respective toner images of the yellow, magenta, cyan, and black, and sequentially multi-transfers the toner images to a recording sheet, such that a full-color image is formed on the recording sheet to complete a print operation. In the following description, the reproduction colors of yellow, magenta, cyan, and black are denoted as Y, M, C and K, respectively, and any structural element related to one of the reproduction colors is denoted by a reference sign attached with an appropriate subscript Y, M, C or K.

The image process unit 3 includes image creation units 3Y, 3M, 3C, and 3K, an exposure unit 10, an intermediate transfer belt 11, a secondary transfer roller 45, and so on. Since the image creation units 3Y, 3M, 3C, and 3K all have the same structures, the following description is given mainly on the structure of the image creation unit 3Y.

The image creation unit 3Y includes a photoconductive drum 31Y and also includes a charger 32Y, a developer 33Y, a primary transfer roller 34Y, a cleaner 35Y, and so on, which are disposed about the photoconductive drum 31Y. The cleaner 35Y is provided for cleaning the photoconductive drum 31Y. The image creation unit 3Y forms a yellow toner image on the photoconductive drum 31Y. The developer 33Y is disposed to face the photoconductive drum 31Y, and carries charged toner particles to the photoconductive drum 31Y. The intermediate transfer belt 11 is an endless belt wound around a drive roller 12 and a passive roller 13 in taut condition to run in the direction indicated by the arrow C. In the vicinity of the passive roller 13, a cleaner 21 is disposed to remove residual toner from the intermediate transfer belt 11.

The exposure unit 10 includes a light emitting element such as a laser diode. In accordance with drive signals output from the control unit 60, the exposure unit 10 emits laser light L to sequentially perform exposure-scanning on the respective photoconductive drums of the image creation units 3Y, 3M, 3C, and 3K to form respective images of the Y, M, C, and K colors. Exposure-scanning for each of the Y, M, C, and K colors is started in accordance with a different timing such that the toner images that are formed on the respective photosensitive drums of the Y, M, C, and K colors are multi-transferred in layered form on the same position on the intermediate transfer belt 11.

Here, the Y-color exposure-scanning is firstly started. When a predetermined duration L0*a* has elapsed after start of the Y-color exposure-scanning, the M-color exposure-scanning is started. When a predetermined duration L0*b* has elapsed after start of the M-color exposure-scanning, the C-color exposure-scanning is started. When a predetermined duration L0*c* has elapsed after start of the C-color exposure-scanning, the K-color exposure-scanning is started.

Here, the durations L0*a*, L0*b*, and L0*c* are durations that are set such that the respective toner images, which are transferred by the image creation units 3Y, 3M, 3C, and 3K, are layered on the intermediate transfer belt 11. In the case where the image creation units 3Y, 3M, 3C, and 3K have the same structure, and the respective exposure positions on the photosensitive drums 31Y, 31M, 31C, and 31K need the same duration to reach the transfer position as a result of rotation of a corresponding one of the photosensitive drums 31Y, 31M, 31C, and 31K, the durations L0*a*, L0*b*, and L0*c* are set as follows. The duration L0*a* is set to a duration which is necessary for the Y-color toner image to be conveyed by the intermediate transfer belt 11 to the transfer position of the M-color toner image, which is on the intermediate transfer belt 11 where the photosensitive drum 31M and the primary transfer roller 34M face each other, after the Y-color toner image reaches the transfer position, which is on the intermediate transfer belt 11 where the photosensitive drum 31Y and the primary transfer roller 34Y face each other.

Similarly, the duration L0*b* is set to a duration which is necessary for the M-color toner image to be conveyed by the intermediate transfer belt 11 to the transfer position of the C-color toner image, which is on the intermediate transfer belt 11 where the photosensitive drum 31C and the primary transfer roller 34C face each other, after the M-color toner image reaches the transfer position, which is on the intermediate transfer belt 11 where the photosensitive drum 31M and the primary transfer roller 34M face each other.

Similarly, the duration L0*c* is set to a duration which is necessary for the C-color toner image to be conveyed by the intermediate transfer belt 11 to the transfer position of the K-color toner image, which is on the intermediate transfer belt 11 where the photosensitive drum 31K and the primary transfer roller 34K face each other, after the C-color toner image reaches the transfer position, which is on the intermediate transfer belt 11 where the photosensitive drum 31C and the primary transfer roller 34C face each other. The durations L0*a*, L0*b*, and L0*c* are determined beforehand by a manufacturer of the printer 1.

As a result of the exposure-scanning, an electrostatic latent image is formed on the photoconductive drum 31Y charged by the charger 32Y. In a similar manner, an electrostatic latent image is formed on the photoconductive drum in each of the image creation units 3M, 3C, and 3K.

Figure 2:
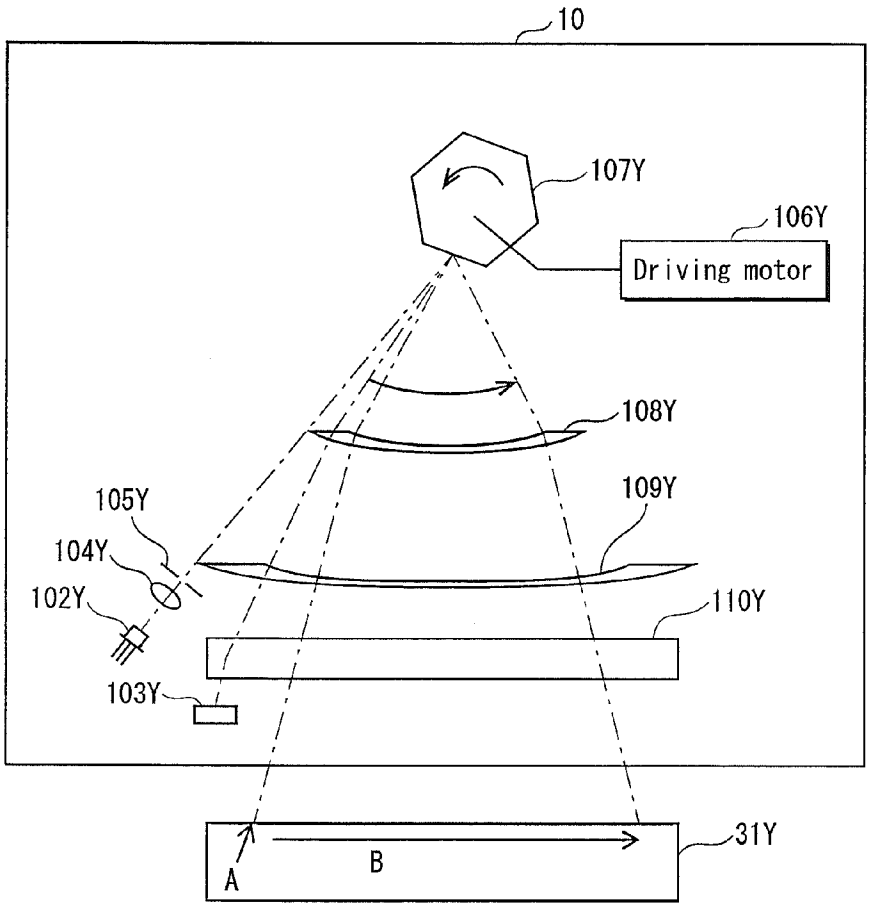
FIG. 2 is a plan view showing a structure of a Y-color laser scanning optical system of an exposure unit 10.

FIG. 2 is a plan view showing a structure of a Y-color laser scanning optical system of the exposure unit 10. As shown in the figure, the Y-color laser scanning optical system includes a semiconductor laser 102Y, an SOS (Start of Scan) sensor 103Y, a collimator lens 104Y, a slit board 105Y, a driving motor 106Y, a polygon mirror 107Y, an fθ lens 108Y, a cylindrical lens 109Y, a reflection mirror 110Y, and so on.

The semiconductor laser 102Y is driven by an LD driver 101Y which is described later to emit laser light. The semiconductor laser 102Y is for example a light emitting element such as a laser diode.

The SOS sensor 103Y is provided in a non-image-formation region beyond an image formation region on the image carrying surface of the photosensitive drum 31Y, specifically on the upstream side, in a scanning direction (indicated by an arrow B in the figure), relative to a scanning start position (indicated by an arrow A in the figure) on which exposure-scanning in the scanning direction is started in accordance with an image signal. The SOS sensor 103Y is an optical sensor for detecting laser light that is forcibly emitted from the semiconductor laser 102Y for a predetermined duration independent from the image signal.

The semiconductor laser 102Y is forced to emit laser light by a CPU 601 transmitting a forcible emission signal to the LD driver 101Y when a scanning position of laser light is led by the polygon mirror 107Y to the front of a scanning position where the laser light is incident on the SOS sensor 103Y. The CPU 601 monitors the scanning position of the laser light through time count using a timer. When the scanning position reaches a predetermined scanning position that is in front of the scanning position where the laser light is incident on the SOS sensor 103Y, the CPU 601 transmits the forcible emission signal.

The SOS sensor 103Y is used for making synchronization in the scanning direction. Before exposure-scanning in the scanning direction is started, the SOS sensor 103Y receives laser light, which transmits through the fθ lens 108Y and the cylindrical lens 109Y and is reflected by the reflection mirror 110Y, and outputs a scanning start signal instructing to start exposure-scanning on one scanning line to the control unit 60. As a result, the scanning position of the laser light in the scanning direction is detected to have moved to the predetermined position which is on the upstream side relative to the scanning start position A in the scanning direction.

The collimator lens 104Y adjusts laser light emitted from the semiconductor laser 102Y so as to be substantially parallel light. The slit board 105Y restricts transmission of the laser light emitted from the collimator lens 104Y so as to adjust the spot shape of the laser light formed on the image carrying surface of the photosensitive drum 31Y.

The polygon mirror 107Y is driven to rotate by the driving motor 106Y at a predetermined rotational speed to polarlize laser light which is incident thereon via the collimator lens 104Y and the slit board 105Y and emit the polarized light to the fθ lens 108Y. As a result, exposure-scanning by laser light is performed on the image carrying surface of the photosensitive drum 31Y at a predetermined speed. Note that the driving motor 106Y is driven by the control unit 60.

The fθ lens 108Y removes field curvature of the laser light which is incident from the polygon mirror 107Y to perform scanning by laser light on the image carrying surface of the photosensitive drum 31Y at a constant velocity. The cylindrical lens 109Y transmits the laser light therethrough which is incident from the fθ lens 108Y to so as to be led to the reflection mirror 110Y.

The reflection mirror 110Y reflects the laser light which is led by the cylindrical lens 109Y to form an image by the laser light on the image carrying surface of the photosensitive drum 31Y. Although the description has been given on the structure of the Y-color laser scanning optical system of the exposure unit 10, M-color, C-color, and K-color laser scanning optical systems have the same structure as the Y-color laser scanning optical system.

Returning to FIG. 1, an electrostatic latent image formed on the photoconductive drum of each color is developed by the developer of a corresponding one of the image creation units 3Y, 3M, 3C, and 3K, such that a toner image of the corresponding color is formed on the photoconductive drum. The toner images thus formed are sequentially transferred in accordance with an appropriately adjusted timing by the primary transfer rollers of the image creation unit 3Y, 3M, 3C, and 3K (in FIG. 1, only the primary transfer roller of the image creation unit 3Y bears the reference sign 34Y, whereas the reference signs of the other primary transfer rollers are omitted) in the process of primary transfer, such that the toner images are layered at the same position on the intermediate transfer belt 11. Then, in the process of secondary transfer, the toner images layered on the intermediate transfer belt 11 are transferred all at once onto a recording sheet by the action of the electrostatic force imposed by the secondary transfer roller 45.

The recording sheet having the toner images secondarily transferred thereon is further carried to the fixing device 5 where the unfixed toner images on the recording sheet is heated and pressed to be thermally fixed. The recording sheet is then ejected by a pair of ejecting rollers 71 onto an exit tray 72.

The sheet feeding unit 4 includes a sheet feeding cassette 41 for storing recording sheets (denoted by a reference sign S in FIG. 1), a pickup roller 42 that picks up recording sheets from the sheet feeding cassette 41 one sheet at a time and feeds the recording sheet onto a conveyance path 43, and a pair of timing rollers 44 that adjust a timing to transport the fed recording sheet to a secondary transfer position 46.

Note that the number of sheet feeding cassettes is not limited to one, and a plurality of sheet feeding cassettes may be provided. Examples of recording sheets include sheets of paper differing in size and thickness (plain paper and thick paper) and film sheets such as OHP film sheets. In the case where a plurality of sheet feeding cassettes are provided, each cassette may be used to store recording sheets of a specific size, thickness, or material.

The timing rollers 44 forward a recording sheet to the secondary transfer position 46 in accordance with a timing when the toner images transferred to be layered on the intermediate transfer belt 11 in the process of primary transfer are carried to the secondary transfer position 46. At the secondary transfer position 46, the toner images layered on the intermediate transfer belt 11 are transferred to the recording sheet at once by the secondary transfer roller 45.

Each roller, including the pickup roller 42 and the pair of timing rollers 44, is powered by a transfer motor which is not illustrated and driven to rotate via power transmission mechanisms, such as gears and belts which are not illustrated. Examples of the transfer motor include a stepping motor capable of controlling the rotational speed with a high precision.

Figure 3:
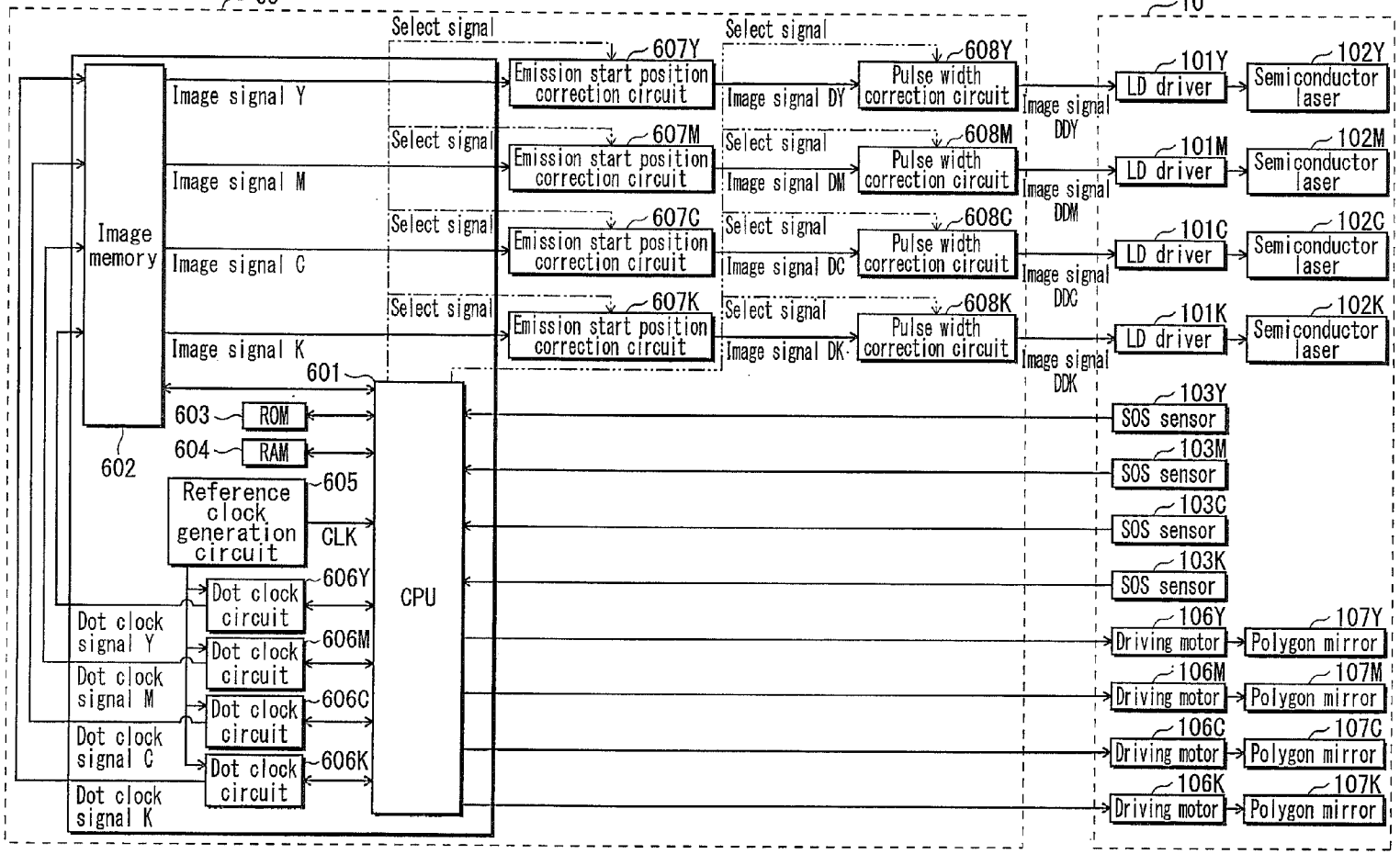
FIG. 3 is a functional block diagram showing a relationship between major structural elements of a control unit 60 relating to exposure control and major structural elements of the exposure unit 10.

[2] Relationship Between Major Structural Elements of Control Unit Relating to Control on Exposure Unit and Major Structural Elements of Exposure Unit FIG. 3 is a functional block diagram showing a relationship between major structural elements of the control unit 60 relating to control on the exposure unit 10 and major structural elements of the exposure unit 10. As shown in the figure, the control unit 60 includes the CPU 601, a ROM (Read Only Memory) 603, a RAM (Random Access Memory) 604, a reference clock generation circuit 605, dot clock circuits 606Y, 606M, 606C, and 606K, emission start position correction circuits 607Y, 607M, 607C, and 607K, pulse width correction circuits 608Y, 608M, 608C, and 608K, and so on.

The exposure unit 10 includes the LD drivers 101Y, 101M, 101C, and 101K, the semiconductor lasers 102Y, 102M, 102C, and 102K, the SOS sensors 103Y, 103M, 103C, and 103K, the driving motors 106Y, 106M, 106C, and 106K, the polygon mirrors 107Y, 107M, 107C, and 107K, and so on.

The image memory 602 stores therein binary bit map data as print image data. For example, a grid matrix such as a 4×4 matrix, an 8×8 matrix, and a 16×16 matrix is virtually regarded as one pixel based on image data composed of a binary image not including half tone and image data including multiple tone. Processing is performed on the grid matrix by an ordered dither method such as the dot system, the vortex method, and the bayer method so as to be converted to binary bit map data. The image memory 602 stores therein such binary bit map data corresponding to image data for one page. The print image data is generated by the control unit 60 based on image data input from a network or an image reading unit which is not illustrated and is included in the printer 1.

The ROM 603 stores therein a program for controlling the exposure unit 10, a program for controlling laser driving control processing which is described later, an emission delay duration specification table used for the laser driving control processing, a position correction amount selection table, a width correction amount selection table, and so on.

The emission delay duration specification table is a table showing a correspondence relationship among (1) a set reference value for exposure intensity of the semiconductor laser used for exposure-scanning of each color, (2) exposure intensity of the semiconductor laser of the corresponding color on each scanning position in the scanning direction of laser light emitted from the semiconductor laser on the image carrying surface of the photosensitive drum of the corresponding color, and (3) an emission delay duration of the corresponding color on the scanning position in the scanning direction (a duration from when the image signal instructs the semiconductor laser to emit laser light to when the semiconductor laser emits laser light). Here, the scanning position in the scanning direction corresponds to a writing start position of laser light of each pixel (a writing start reference position, which is described later). The emission delay duration specification table has been created beforehand by the manufacturer of the printer 1 making tests for checking the correspondence relationship.

Note that the emission delay duration specification table used here is common among the Y, M, C, and K colors. Alternatively, a different emission delay duration specification table may be prepared for each color.

Even in the case where the semiconductor laser which emits laser light at a constant amount of laser light (exposure intensity) is used for exposure-scanning of each color, the amount of laser light might differ depending on the scanning positions due to variation of properties and variation over time and so on caused by temperature variation of a scanning lens which occur until flux of laser light being scanned in the scanning direction reflected by the polygon mirror reaches the image carrying surface of the photosensitive drum through the optical system.

For example, there is a case where properties are observed that the amount of laser light reaches the maximum around the center on the scanning line in the scanning direction, and the closer to the ends on the scanning line the scanning position is, the smaller the amount of laser light is. For this reason, the amount of laser light emitted from the semiconductor laser is finely adjusted (increased or decreased) depending on the scanning position such that the variation of the amount of laser light between the scanning positions is cancelled, and as a result the respective amounts of laser light on the scanning positions in the scanning direction are constant. Specifically, a test is performed beforehand for each set reference value for amount of laser light which is set for the semiconductor laser (set reference value for exposure intensity) to calculate a variation value for amount of laser light emitted at the set reference value for exposure intensity on each scanning position based on the set reference value for exposure intensity. A table is created which shows a correspondence relationship between the scanning positions and exposure intensities after correction of the variation value. The exposure intensity of laser light emitted from the semiconductor laser is controlled depending on the scanning position with reference to the table such that the variation value is cancelled. This control might result in difference in emission delay duration due to the exposure intensity which increases or decreases depending on the scanning position in the scanning direction.

In the preset embodiment, the emission delay duration specification table is created in order to cancel misalignment in image forming position between pixels due to the difference in emission delay duration between the scanning positions in the scanning direction. FIG. 4 shows a specific example of the emission delay duration specification table. In the emission delay duration specification table, the scanning position is indicated by a count value of a dot clock signal which is described later. In the figure, reference signs P1 , P2, and P3 each indicate a set reference value, reference signs P10, . . . , P1n, P20, . . . , P2n, and P30, . . . , P3n each indicate exposure intensity on a corresponding scanning position, reference signs c0, . . . , cn each indicate a count value of the dot clock signal.

The dot clock signal is a clock signal having a frequency of inverse of a duration necessary to write one dot (pixel) into the photosensitive drum of a corresponding color. For each time the dot clock signal is output to the image memory 602, the image memory 602 converts image data corresponding to one pixel to an image signal, which is a pulse signal instructing to turn on and off emission and an emission duration of laser light emitted from the semiconductor laser, and outputs the image signal.

The dot clock signal is counted for each exposure-scanning by one scanning line. The count number specifies what number of an image signal of a pixel that is output from the image memory 602 after start of the exposure-scanning, and thereby specifies a current scanning position of laser light (a writing start reference position of laser light relating to the image signal of the output pixel, which is described later). The number and intervals of dots (pixels) written in the scanning direction are determined beforehand based on the resolution and so on. Accordingly, it is possible to specify the current scanning position of laser light in the scanning direction by specifying the order of an image signal of an output pixel.

Also, the position correction amount selection table is a table showing a correspondence relationship among an emission delay duration, an output delay duration, and a select signal used for selecting the output delay duration. The position correction amount selection table has been created beforehand by the manufacturer of the printer 1 making tests for checking the correspondence relationship.

Here, the output delay duration is a delay duration for delaying a timing to input an image signal of a pixel of each color, which is sequentially output from the image memory 602 in units of pixels, to the pulse width correction circuit of a corresponding color, such that a writing start position relating to the image signal in the laser light scanning direction corresponds to a predetermined reference position irrespective of the difference in emission delay duration between the scanning positions in the laser light scanning direction. Here, the predetermined reference position indicates a position of the front edge part in the scanning direction on the image formation region on the image carrier surface of the photosensitive drum of the corresponding color, and a position of each of parts which are sectioned at one-pixel intervals from the image formation region including from the front edge part to the tail edge part in the scanning direction. Also, such a predetermined reference position is hereinafter referred to as a writing start reference position. Furthermore, the position of the front edge part in the image formation region in the scanning direction is hereinafter referred to as a scanning start reference position. Note that the output delay duration is determined for each writing start reference position.

The image memory 602 starts outputting an image signal of each color in accordance with a timing that is (1) after a timing when a scanning start signal, which is output from the SOS sensor of the corresponding color (the SOS sensor 103Y, 103M, 103C, or 103K) of the exposure unit 10 to the CPU 601, is detected and (2) before a timing when the scanning position of laser light of the corresponding color moves to the scanning start reference position on the image carrying surface of the photosensitive drum of the corresponding color. This movement is controlled by the CPU 601 on the driving motor of the corresponding color (the driving motor 106Y, 106M, 106C, or 106K), which drives the polygon mirror of the corresponding color (the polygon mirror 107Y, 107M, 107C, or 107K) to rotate. The scanning start reference position is the position of the front edge part in the image formation region in the scanning direction on the image carrying surface of the photosensitive drum of the corresponding color.

Specifically, the Y-color image signal is output from the image memory 602 in accordance with a timing when a duration L1Y-α has elapsed after detection of the Y-color scanning start signal. The M-color image signal is output from the image memory 602 in accordance with a timing when a duration L1M-α has elapsed after detection of the M-color scanning start signal. The C-color image signal is output from the image memory 602 in accordance with a timing when a duration L1C-α has elapsed after detection of the C-color scanning start signal. The K-color image signal is output from the image memory 602 in accordance with a timing when a duration L1K-α has elapsed after detection of the K-color scanning start signal.

The character string L1Y represents a duration which is necessary for the scanning position of the laser light to move to the scanning start reference position on the image carrying surface of the Y-color photosensitive drum after detection of the Y-color scanning start signal. The character string L1M represents a duration which is necessary for the scanning position of the laser light to move to the scanning start reference position on the image carrying surface of the M-color photosensitive drum after detection of the M-color scanning start signal.

The character string L1C represents a duration which is necessary for the scanning position of the laser light to move to the scanning start reference position on the image carrying surface of the C-color photosensitive drum after detection of the C-color scanning start signal. The character string L1K represents a duration which is necessary for the scanning position of the laser light to move to the scanning start reference position on the image carrying surface of the K-color photosensitive drum after detection of the K-color scanning start signal.

Furthermore, the character α represents a duration which is set for making the timing when the respective image signals of the Y, M, C, and K colors are output from the image memory 602 to be prior to the timing when the scanning position of the laser light moves to the scanning start reference position. The duration α may be set to a predetermined duration that is longer than the longest one of the emission delay durations on the scanning positions of each color and is shorter than the shortest one of the durations L1Y, L1M, L1C, and L1K. Note that the duration α may differ for each color. In this case, the duration α may be set to a predetermined duration that is longer than the longest one of the emission delay durations on the scanning positions of the color and is shorter than the duration of the color necessary to move to the scanning start reference position.

The output delay duration is obtained by calculating a difference between the duration α and the emission delay duration on each scanning position which is equivalent to the writing start reference position. FIG. 5 shows a specific example of the position correction amount selection table. In the figure, the output delay duration is set so as to decrease as the emission delay duration increases (T1<T2<T3<T4<T5<T6<T7<T8<T9<T10<T11<T12<T13<T14<T15<T16).

Also, the width correction amount selection table is a table showing a correspondence relationship between an emission delay duration and a select signal used for selecting an emission extension duration, and is used for determining an extended amount for extending the emission duration of laser light by the emission delay duration. The width correction amount selection table has been created beforehand by the manufacturer of the printer 1 making tests for checking the correspondence relationship. FIG. 6 shows a specific example of the width correction amount selection table.

The RAM 604 is used by the CPU 601 as a work area at the time of program execution. The reference clock generation circuit 605 generates a clock signal CLK, and outputs the clock signal CLK to the CPU 601 and the dot clock circuits 606Y, 606M, 606C, and 606K. The CPU 601 drives based on the clock signal CLK. The dot clock circuits 606Y, 606M, 606C, and 606K respectively generate dot clock signals Y, M, C, and K based on the clock signal CLK.

The emission start position correction circuits 607Y, 607M, 607C, and 607K are each a correction circuit for delaying a timing to input an image signal of a corresponding color (the image signal Y, M, C, or K), which is output from the image memory 602 in units of pixels, to the pulse width correction circuit of the corresponding color. Hereinafter, the image signals Y, M, C, and K whose input timings have been respectively delayed by the emission start position correction circuits 607Y, 607M, 607C, and 607K are referred to as delayed image signals DY, DM, DC, and DK, respectively.

The pulse width correction circuits 608Y, 608M, 608C, and 608K are each a correction circuit for expanding the pulse width of a corresponding one of the delayed image signals DY, DM, DC, and DK, which is input from the emission start position correction circuit of the corresponding color, by a pulse width corresponding to an emission delay duration relating to the input image signal. Hereinafter, the delayed image signals DY, DM, DC, and DK whose pulse widths have been respectively expanded by the pulse width correction circuits 608Y, 608M, 608C, and 608K are referred to as expanded image signals DDY, DDM, DDC, and DDK, respectively. The expanded image signals DDY, DDM, DDC, and DDK are each input to the LD driver of the corresponding color.

Figure 7:
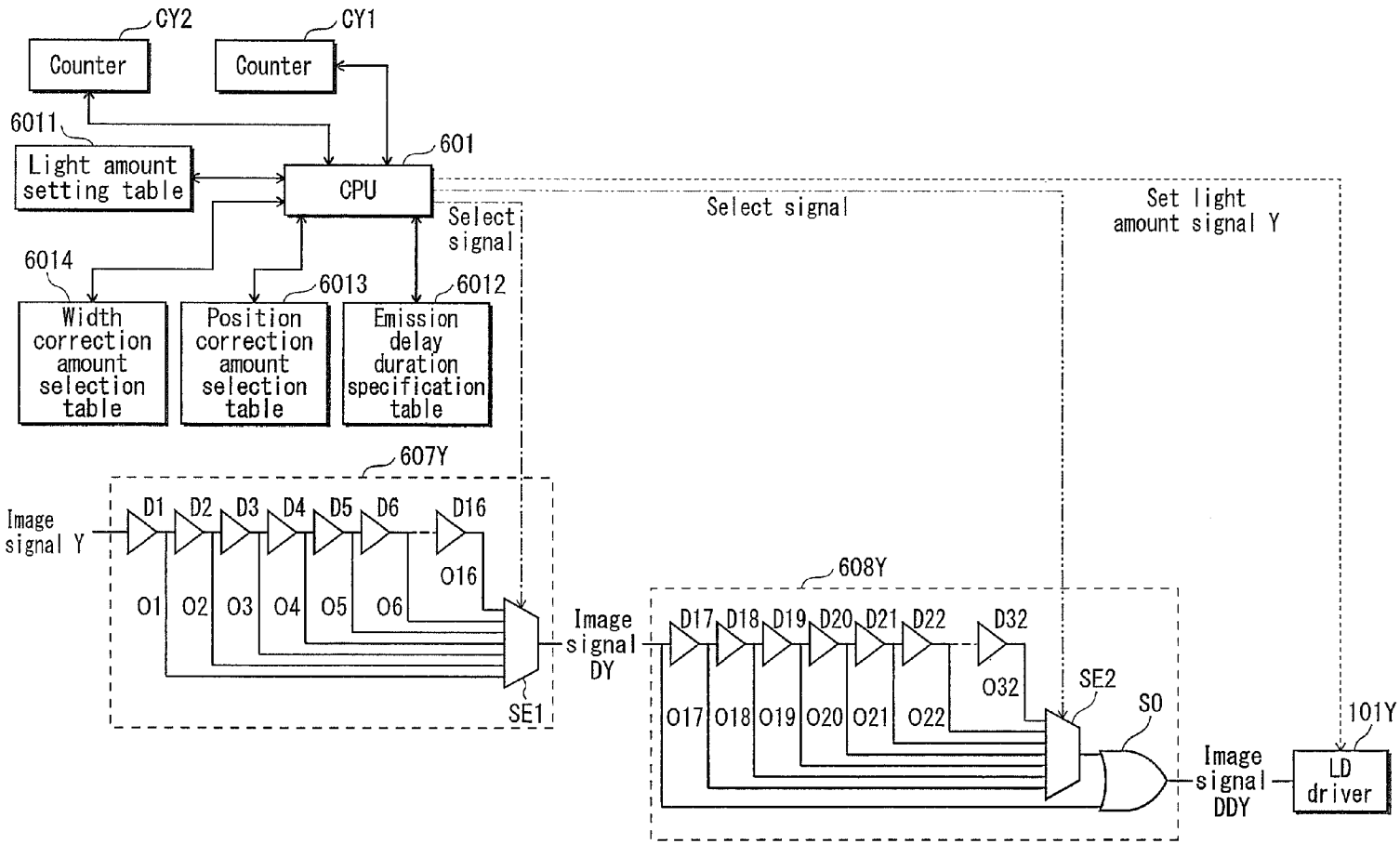
FIG. 7 is a functional block diagram showing major structural elements relating to Y-color laser driving control.

FIG. 7 is a functional block diagram showing major structural elements relating to Y-color laser driving control, which include the emission start position correction circuit 607Y and the pulse width correction circuit 608Y. The following further describes in detail the structure of the emission start position correction circuit 607Y and the pulse width correction circuit 608Y, with reference to the figure. The emission start position correction circuit 607Y includes plural phase (here, 16-phase) buffer circuits D1 to D16 for delaying the image signal Y, and a selector SE1 for selecting any of outputs 01 to 016 from the buffer circuits D1 to D16 in accordance with a select signal input from the CPU 601. The CPU 601 specifies a select signal to be input to the emission start position correction circuit 607Y with reference to the position correction amount selection table, and inputs the specified select signal to the selector SE1.

As shown in the specific example of the position correction amount selection table in FIG. 5, select signals S1 to S16 each indicate selection of output from the buffer circuit having a number common with the select signal. For example, the select signal S1 indicates selection of the output 01, the select signal S2 indicates selection of the output 02, the select signal S3 indicates selection of the output 03.

The pulse width correction circuit 608Y includes plural phase (here, 16-phase) buffer circuits D17 to D32 for delaying the image signal DY, a selector SE2 for selecting any of outputs 017 to 032 from the buffer circuits D17 to D32 in accordance with a select signal input from the CPU 601, and an OR circuit SO for outputting a logical add (OR) of the delayed image signal DY input from the emission start position correction circuit 607Y and the output from the buffer circuit selected by the selector SE2. The CPU 601 specifies a select signal to be input to the pulse width correction circuit 608Y with reference to the width correction amount selection table, and inputs the specified select signal to the selector SE2.

As shown in the specific example of the width correction amount selection table in FIG. 6, select signals S17 to S32 each indicate selection of output from the buffer circuit having a number common with the select signal. For example, the select signal S17 indicates selection of the output 017, the select signal S18 indicates selection of the output 018, the select signal S19 indicates selection of the output 019.

A counter CY1 is a counter for counting a duration from when a scanning start signal, which is input from the SOS sensor 102Y to the CPU 601, is detected to when the memory 602 starts outputting the image signal Y. The CPU 601 sets a count value of the counter CY1 (the count value here is set to a value βY) such that the counted duration corresponds to the duration L1Y-α, and then the counter CY1 starts time count.

A counter CY2 is a counter that is activated when the count value of the counter CY1 reaches the set count value βY, and is for counting the dot clock signal Y output from the dot clock circuit 604Y to the image memory 602. Each time output of the image signals Y corresponding to one line in the scanning direction (one scanning line) completes, the count value of the counter CY2 is initialized to zero by the CPU 601.

A light amount setting table 6011 is a table showing a correspondence relationship between an image forming condition and the set reference value for exposure intensity of the semiconductor laser of each of the Y, M, C, and K colors (the semiconductor laser 102Y, 102M, 102C, or 102K) used according to the image forming condition. Upon receiving an instruction to start an image forming operation, the CPU 601 specifies the set reference value for exposure intensity of the semiconductor laser 102Y used in the image forming operation with reference to the light amount setting table 6011.

Furthermore, the CPU 601 determines exposure intensity on each scanning position (a count value of each dot clock signal) with respect to the specified set reference value with reference to an emission delay duration specification table 6012, and transmits a set light amount signal Y indicating the determined exposure intensity to the LD driver 101Y which drives the semiconductor laser 102Y.

Moreover, the CPU 601 specifies an emission delay duration with respect to the determined exposure intensity on each scanning position with reference to the emission delay duration specification table 6012. Furthermore, the CPU 601 selects a select signal corresponding to the specified emission delay duration with reference to the position correction amount selection table 6013 and the width correction amount selection table 6014, and inputs the selected select signal to the selector SE1 of the emission start position correction circuit 607Y and the selector SE2 of the pulse width correction circuit 608Y.

Major structural elements relating to laser driving control of the M, C, and K colors have the same structure as those shown in FIG. 7. Specifically, instead of the counters CY1 and CY2, the emission start position correction circuit 607Y, the pulse width correction circuit 608Y, and the LD driver 101Y, the major structural elements relating to the M-color laser driving control include counters CM1 and CM2, the emission start position correction circuit 607M, the pulse width correction circuit 608M, and the LD driver 101M. Similarly, the major structural elements relating to the C-color laser driving control include counters CC1 and CC2, the emission start position correction circuit 607C, the pulse width correction circuit 608C, and the LD driver 101C. Similarly, the major structural elements relating to the K-color laser driving control include counters CK1 and CK2, the emission start position correction circuit 607K, the pulse width correction circuit 608K, and the LD driver 101K. Other major structural elements (the CPU 601, the light amount setting table 6011, the emission delay duration specification table 6012, the position correction amount selection table 6013, and the width correction amount selection table 6014) are common among the Y, M, C, and K colors.

Similarly to the counter CY1, the counters CM1, CC1, and CK1 are each a counter for counting a duration from when a scanning start signal, which is input from the SOS sensor of the corresponding color (the SOS sensor 102M, 102C, or 102K) to the CPU 601, is detected to when the memory 602 starts outputting the image signal of the corresponding color (the image signal M, C, or K).

The CPU 601 sets the count value of the counter CM1 to a value βM such that the counted duration corresponds to the duration L1M-α. The CPU 601 sets the count value of the counter CC1 to a value βC such that the counted duration corresponds to the duration L1C-α. The CPU 601 sets the count value of the counter CK1 to a value βK such that the counted duration corresponds to the duration L1K-α.

Similarly to the counter CY2, the counters CM2, CC2, and CK2 are each a counter that is activated when the count value of the counter of the corresponding color (the counter CM1, CC1, or CK1) reaches the set count value (the count value βM, βC, or βK), and is for counting the dot clock signal M, C, or K output from the dot clock circuit of the corresponding color (the dot clock circuit 604M, 604C, or 604K) to the image memory 602. Each time output of each of the image signals M, C, and K corresponding to one line in the scanning direction (one scanning line) completes, the count value of the counter of the corresponding color (the counter CM2, CC2, or CK2) is initialized to zero by the CPU 601.

Returning to FIG. 3, the LD drivers 101Y, 101M, 101C, and 101K each drive the semiconductor laser of the corresponding color in accordance with the image signal input from the pulse width correction circuit of the corresponding color to emit light at exposure intensity indicated by the set light amount signal transmitted from the CPU 601. Upon receiving laser light forcibly emitted from the semiconductor laser of the corresponding color, the SOS sensor 103Y, 103M, 103C, and 103K each emit a scanning start signal to the CPU 601. Also, the driving motors 106Y, 106M, 106C, and 106K each drive the polygon mirror of the corresponding color to rotate.

Figure 8:
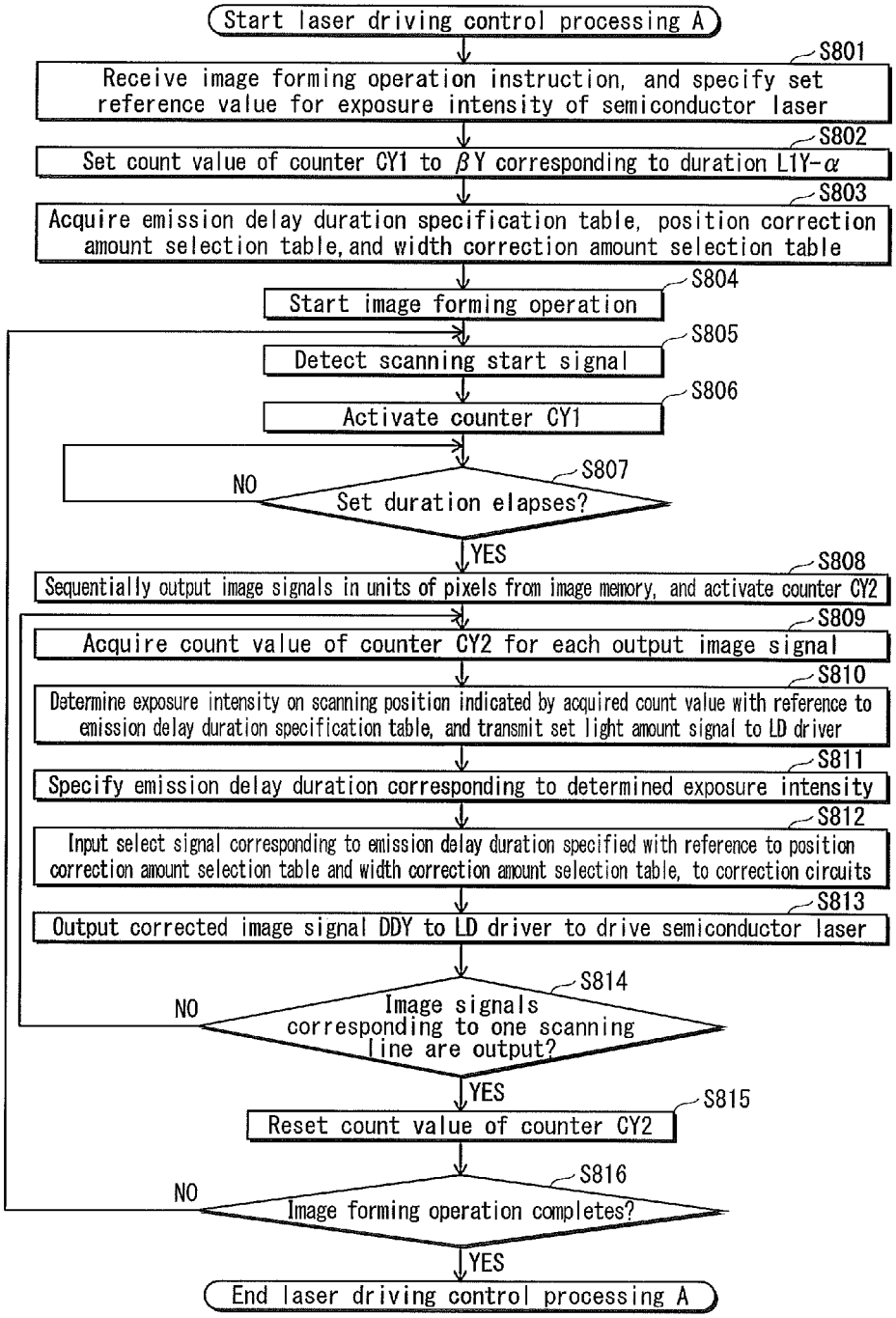
FIG. 8 is a flow chart showing operations of Y-color laser driving control processing A with use of an emission start position correction circuit 607Y and a pulse width correction circuit 608Y.
Figure 9A:
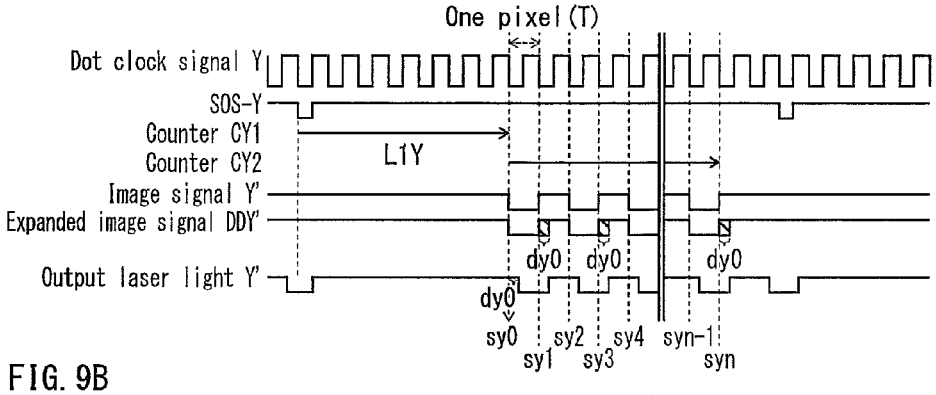
FIG. 9A to FIG. 9D are respective timing charts relating to laser driving control of Y, M, C, and K colors in a comparative example.
Figure 9B:
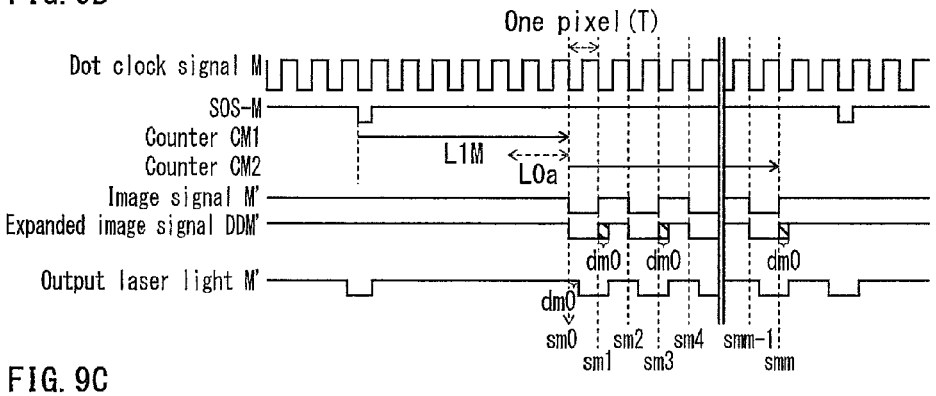
Figure 9C:
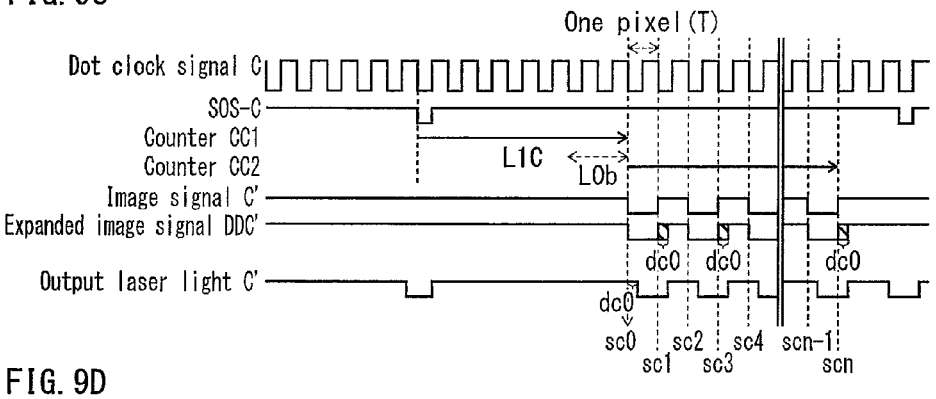
Figure 9D:
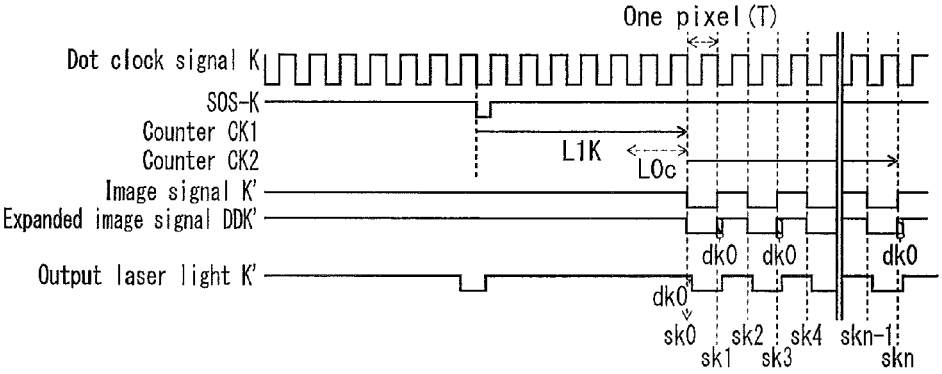
Figure 10:
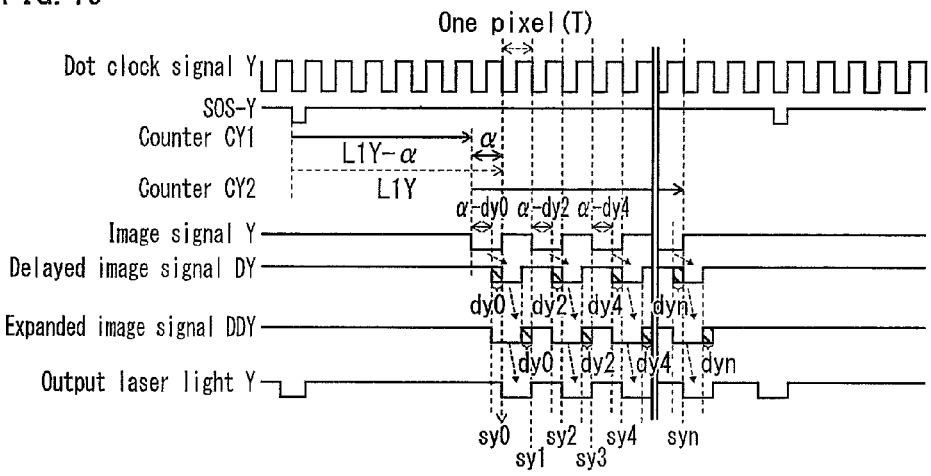
FIG. 10 is a timing chart relating to Y-color laser driving control in an embodiment.
Figure 11:
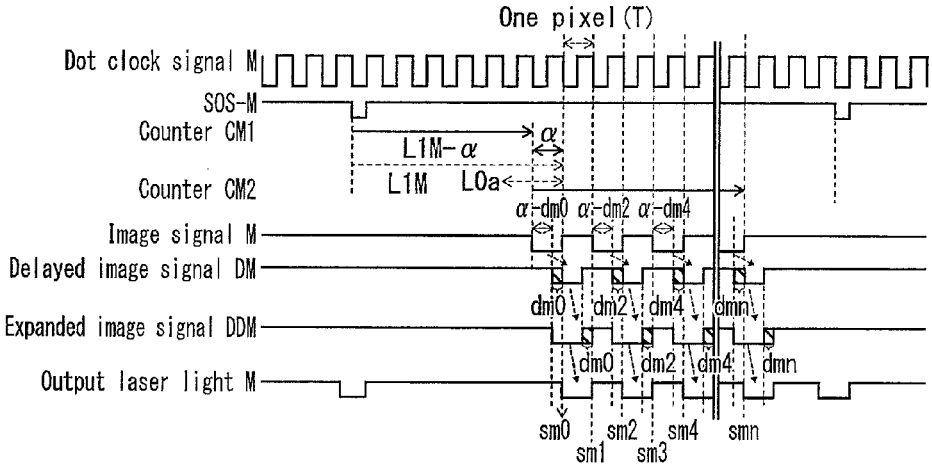
FIG. 11 is a timing chart relating to M-color laser driving control in the embodiment.
Figure 12:
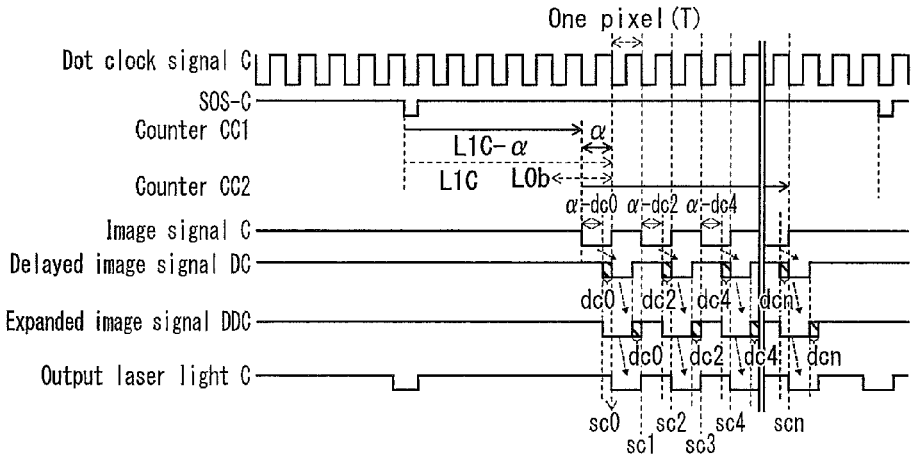
FIG. 12 is a timing chart relating to C-color laser driving control in the embodiment.
Figure 13:
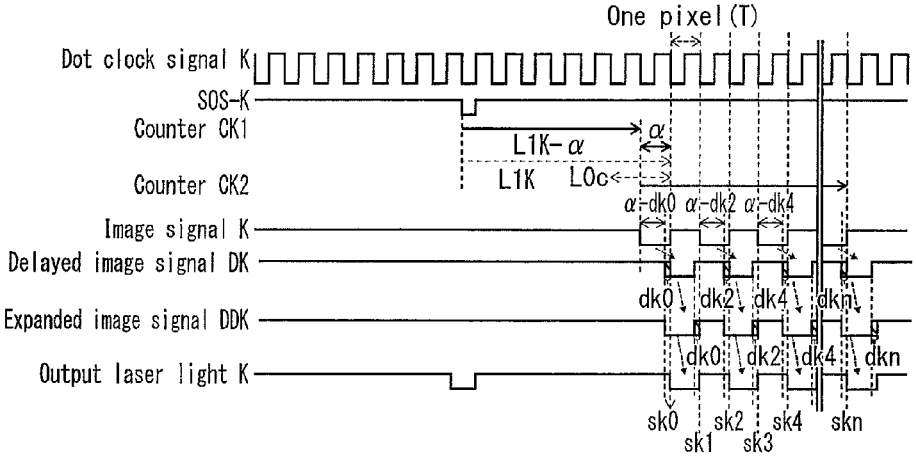
FIG. 13 is a timing chart relating to K-color laser driving control in the embodiment.

FIG. 8 is a flow chart showing operations of Y-color laser driving control processing A with use of the emission start position correction circuit 607Y and the pulse width correction circuit 608Y. Upon receiving an instruction to start an image forming operation via the network or the operation panel, the CPU 601 specifies a set reference value for exposure intensity of the semiconductor laser 102Y used in the image forming operation with reference to the light amount setting table 6011 (Step S801).

Next, the CPU 601 sets the count value of the counter CY1 to βY corresponding to the duration L1Y-α (Step S802). The CPU 601 acquires the emission delay duration specification table 6012, the position correction amount selection table 6013, and the width correction amount selection table 6014 from the ROM 603 (Step S803), and drives the exposure unit 10 to start the image forming operation (Step S804).

When a scanning start signal output from the SOS sensor 103Y is detected (Step S805), the CPU 601 activates the counter CY1 and controls the counter CY1 to start time count (Step S806). When the count value of the counter CY1 reaches the value βY, and the set duration L1Y-α elapses after start of the time count (Step S807: YES), the CPU 601 initializes the count value of the counter CY1 to zero. Then, the CPU 601 controls the dot clock circuit 606Y to output the dot clock signal Y to the image memory 602 so as to control the image memory 602 to output sequentially the image signals Y in units of pixels. The CPU 601 activates the counter CY2 and controls the counter CY2 to start counting the dot clock signal Y output to the image memory 602 (Step S808).

Each time the image signal Y is output, the CPU 601 acquires the count value of the counter CY2 (Step S809). With reference to the emission delay duration specification table 6012, the CPU 601 determines exposure intensity corresponding to the specified set reference value and the acquired count value as exposure intensity with respect to a scanning position indicated by the acquired count value, and transmits a set light amount signal Y indicating the determined exposure intensity to the LD driver 101Y, which drives the semiconductor laser 102Y (Step S810). Furthermore, the CPU 601 specifies an emission delay duration with respect to the determined exposure intensity (Step S811).

Next, the CPU 601 specifies a select signal corresponding to the specified emission delay duration with reference to the position correction amount selection table 6013 and the width correction amount selection table 6014, and inputs the specified select signal to the emission start position correction circuit 607Y and the pulse width correction circuit 608Y (Step S812).

As a result, the exposure intensity relating to the image signal Y, the output delay duration of the image signal Y, which is to be used in the emission start position correction circuit 607Y, and the emission extension duration, which is to be used in the pulse width correction circuit 608Y, are selected in accordance with a timing synchronized with output of the image signal Y.

Then, the CPU 601 corrects the output image signal Y via the emission start position correction circuit 607Y and the pulse width correction circuit 608Y to generate an expanded image signal DDY, and controls the generated expanded image signal DDY to be output to the LD driver 101Y, and then controls the LD driver 101Y to drive the semiconductor laser 102Y based on the expanded image signal DDY (Step S813). When the count value of the counter CY2 reaches the number of the output image signals Y corresponding to one line in the scanning direction (one scanning line) (Step S814: YES), the CPU 601 resets the count value of the counter CY2 to zero (Step S815). When the image forming operation does not complete (Step S816: NO), the CPU 601 moves onto Step S805.

When the judgment result in Step S814 is negative (Step S814: NO), the CPU 601 moves onto Step S809.

Except the specified set reference value for exposure intensity, the exposure intensity and the emission delay duration determined for each scanning position, which differ for each color, laser driving control processing A of the M, C, and K colors is performed similarly to the Y-color laser driving control processing A. Specifically, the laser driving control processing A of the M, C, and K colors is performed via the emission start position correction circuit of the corresponding color (the emission start position correction circuit 607M, 607C, or 607K) and the pulse width correction circuit of the corresponding color (the pulse width correction circuit 608M, 608C, or 608K).

FIG. 9A to FIG. 9D are respective timing charts of laser driving control of the Y, M, C, and K colors relating to a comparative example. FIG. 10 to FIG. 13 are respective timing charts of laser driving control of the Y, M, C, and K colors relating to the present embodiment. A control unit performing the laser driving control in the comparative example differs from the control unit 60 relating to the present embodiment in terms of not including an emission start position correction circuit.

Furthermore, the laser driving control in the comparative example differs from that in the present embodiment as follows. According to the laser driving control in the comparative example, with respect to each of the Y, M, C, and K colors, an emission delay duration is specified based on only exposure intensity of the semiconductor laser on a predetermined scanning position (the scanning start reference position, here) without consideration for variation in amount of laser light depending on the scanning position in the scanning direction, and a select signal corresponding to the specified emission delay duration is selected with reference to the width correction amount selection table. In the comparative example similarly to the present embodiment, the amount of laser light emitted from the semiconductor laser is finely adjusted depending on the scanning position such that the respective amounts of laser light on the scanning positions are constant.

The following describes the laser driving control in the comparative example. In the description, structural elements having the same structure as the control unit 60 are denoted by the same reference signs as the structural elements of the present embodiment. FIG. 9A to FIG. 9D are respective timing charts of laser driving control of the Y, M, C, and K colors relating to the comparative example. The laser driving control of the Y, M, C, and K colors is sequentially started in accordance with a different timing such that toner images that are formed on the respective photosensitive drums of the Y, M, C, and K colors are multi-transferred in layered form on the same position on the intermediate transfer belt 11. The laser driving control of the Y, M, C, and K colors is started in a stated order here. Since the laser driving control of the Y, M, C, and K colors is the same except for the different start timing, the timing charts of the laser driving control of the Y, M, C, and K colors are collectively described below.

As shown in FIG. 9A to FIG. 9D, when a scanning start signal output from each of the respective SOS sensors of the Y, M, C, and K colors (the SOS sensors 103Y, 103M, 103C, and 103K) is detected, that is, when scanning start signals SOS-Y, SOS-M, SOS-C, and SOS-K each fall, the respective counters of the Y, M, C, and K colors (the counters CY1, CM1, CC1, and CK1) are each activated by the CPU 601. When a count value of the counter of each color reaches a corresponding one of respective count values (count values β0Y, β0M, β0C, and β0K) corresponding to the duration (the duration L1Y, L1M, L1C, or L1K) after detection of the scanning start signal of the corresponding color (from the fall position of the scanning start signal), dot clock signals (dot clock signals Y, M, C, and K) are each output from the dot clock circuit of the corresponding color to the image memory 602. Also, an image signal of each color (an image signal Y', M', C', or K') is sequentially output from the image memory 602 in units of pixels (in one clock cycle T here), and another counter of the corresponding color (a counter CY2, CM2, CC2, or CK2) is activated by the CPU 601, and count of dot clock signals that are output to the image memory 602 is started. The durations L1Y, L1M, L1C, and L1K indicates a duration that is necessary for a scanning position of laser light of the corresponding color to move to the scanning start reference position of the corresponding color (the scanning start reference position sy0, sm0, sc0, or sk0).

While the image signal of each color (the image signal Y', M', C', or K') in the low status instructs to turn on emission of laser light, the image signal of each color in the high status instructs to turn off emission of laser light.

Also, the duration L1M is set such that a timing when the scanning position of M-color laser light reaches the scanning start reference position sm0 of the M-color laser light is delayed by the duration L0*a* behind a timing when the scanning position of Y-color laser light reaches the scanning start reference position sy0 of the Y-color laser light. This is in order to multi-transfer the toner images formed on the respective photosensitive drums of the Y, M, C, and K colors in layered form on the same position on the intermediate transfer belt 11.

Similarly, the duration L1C is set such that a timing when the scanning position of C-color laser light reaches the scanning start reference position sc0 of the C-color laser light is delayed by the duration L0*b* behind the timing when the scanning position of M-color laser light reaches the scanning start reference position sm0 of the M-color laser light. Furthermore, when the duration L1K is set such that a timing when the scanning position of K-color laser light reaches the scanning start reference position sk0 of the K-color laser light is delayed by the duration L0*c* behind the timing when the scanning position of C-color laser light reaches the scanning start reference position sc0 of the C-color laser light.

Next, the respective image signals of the Y, M, C, and K colors, which are sequentially output, are each input to the pulse width correction circuit of the corresponding color (the pulse width correction circuit 608Y, 608M, 608C, or 608K), and the pulse width of the image signal is expanded such that an emission duration is extended by an emission delay duration of the corresponding color (an emission delay duration dy0, dm0, dc0, or dk0) (hatched part in the figures). The image signals having the expanded pulse width of each color (expanded image signal DDY', DDM', DDC', or DDK') are each sequentially input to the LD driver of the corresponding color (the LD driver 101Y, 101M, 101C, or 101K).

The semiconductor lasers of each color (the semiconductor laser 102Y, 102M, 102C, or 102K) is driven based on the expanded image signal of the corresponding color. Output of laser light of the corresponding color (laser light Y', M', C', or K') is delayed behind input of the expanded image signal of the corresponding color by the emission delay duration of the corresponding color.

In this way, output of laser light of each color is delayed behind start of driving of the semiconductor laser of the corresponding color by the emission delay duration of the corresponding color, even in the case where driving of the semiconductor laser is started as follows.

Specifically, after elapse of the duration which is necessary for the scanning position of the light of the corresponding color to move to the scanning start reference position, output of an image signal of the corresponding color is started in accordance with a timing when a scanning position of laser light of the corresponding color moves to the scanning start reference position of the corresponding color on the image carrying surface of the photosensitive drum of the corresponding color. Then, the expanded image signal is input to the LD driver of the corresponding color to drive the semiconductor laser of the corresponding color.

As a result, laser light writing of each color in the scanning direction is started on a position that is misaligned from the scanning start reference position of the corresponding color toward the downstream side in the scanning direction. Then, a writing start position of laser light relating to the image signal of each color (an image signal instructing to turn on emission of laser light) which is sequentially output in units of pixels is also misaligned from a writing start reference position relating to the image signal of the color (a writing start reference position sy2, sy4, syn-1, sm2, sm4, smn-1, sc2, sc4, scn-1, sk2, sk4, or skn-1) toward the downstream side in the scanning direction.

An amount of positional misalignment differs depending on the exposure intensity of the semiconductor laser of the corresponding color. This is because the emission delay duration differs depending on the exposure intensity. Also, the amount of positional misalignment slightly differs depending on the writing start reference positions of the corresponding color (the writing start reference position sy0 to syn, sm0 to smn, sc0 to scn, or sk0 to skn). This is because the emission delay duration differs depending on the scanning position in the scanning direction.

Therefore, even if the writing start reference positions of the Y, M, C, and K colors are set in advance so as to coincident with each other on the image carrying surface of the photosensitive drums in the laser light scanning direction, color misregistration occurs between the Y, M, C, and K colors for image formation by layering images of the colors. This is because difference occurs due to in amount of misalignment in writing start position of laser light from the writing start reference position between the Y, M, C, and K colors.

The following describes the laser driving control in the present embodiment with reference to FIG. 10 to FIG. 13. FIG. 10 to FIG. 13 show timing charts of the laser driving control of the Y, M, C, and K colors, respectively. In the present embodiment similarly to the comparative example, the laser driving control of the Y, M, C, and K colors is sequentially started in accordance with a different timing such that toner images that are formed on the respective photosensitive drums of the Y, M, C, and K colors are multi-transferred in layered form on the same position on the intermediate transfer belt 11. The laser driving control of the Y, M, C, and K colors is started in a stated order here.

Also similarly to the comparative example, since the laser driving control of the Y, M, C, and K colors in the present embodiment is the same except for the different start timing, the timing charts of the laser driving control of the Y, M, C, and K colors are collectively described below.

As shown in FIG. 10 to FIG. 13, when a scanning start signal output from each of the respective SOS sensors of the Y, M, C, and K colors (the SOS sensors 103Y, 103M, 103C, and 103K) is detected, that is, when scanning start signals SOS-Y, SOS-M, SOS-C, and SOS-K each fall, the respective counters of the Y, M, C, and K colors (the counters CY1, CM1, CC1, and CK1) are each activated by the CPU 601.

When a count value of the counter of each color reaches a corresponding one of respective count values (count values βY, βM, βC, and βK) corresponding to a duration (a duration L1Y-α, L1M-α, LIC-α, or L1K-α) after detection of the scanning start signal of the corresponding color (from the fall position of the scanning start signal), dot clock signals (dot clock signals Y, M, C, and K) are each output from the dot clock circuit of the corresponding color to the image memory 602. Also, image signals of the colors (image signals Y, M, C, and K) are sequentially output from the image memory 602 in units of pixels (in one clock cycle T here), and another counters of the colors (the counters CY2, CM2, CC2, and CK2) are activated by the CPU 601, and count of dot clock signals that are output to the image memory 602 is started. The durations L1Y-α, L1M-α, LIC-α, are L1K-α are each shorter by the duration α than the corresponding duration (the duration L1Y, L1M, L1C, or L1K) which is necessary for a scanning position of laser light of the corresponding color to move to the scanning start reference position of the corresponding color (the scanning start reference position sy0, sm0, sc0, or sk0).

While the image signals of the respective colors (the image signals Y, M, C, and K) in the low status each instruct to turn on emission of laser light, the image signals of the respective colors (the image signals Y, M, C, and K) in the high status each instruct to turn off emission of laser light.

As a result, output of the image signal of each color is started the duration α prior to elapse of the duration (the duration L1Y, L1M, L1C, or L1K) which is necessary for the scanning position of the laser light of the corresponding color to move to the scanning start reference position on the image carrying surface of the photosensitive drum of the corresponding color.

Note that the durations L1Y, L1M, L1C, and L1K are set in the same manner as in the laser driving control in the comparative example, such that toner images that are formed on the respective photosensitive drums of the Y, M, C, and K colors are multi-transferred in layered form on the same position on the intermediate transfer belt 11.

Next, the respective image signals of the Y, M, C, and K colors (the image signals Y, M, C, and K), which are sequentially output, are each input to the emission start position correction circuit (the emission start position correction circuit 607Y, 607M, 607C, or 607K). As indicated by a dashed line arrow that is diagonally downward from left to right on the uppermost section in the timing chart of the corresponding color, the image signal of the color is delayed by the emission start position correction circuit of the corresponding color by a duration corresponding to a difference (a difference α-dyk, α-dmk, α-dck, or α-dkk, where k in the end of each character string represents a variable for specifying a writing start reference position relating to the image signal of the color) between the duration α and an emission delay duration (an emission delay duration dyk, dmk, dck, or dkk) on the scanning position of the laser light relating to the image signal of the color (the writing start reference position relating to the image signal of the color). Furthermore, the delayed image signals of each color (the delayed image signals DY, DM, DC, and DK) are each sequentially input to the pulse width correction circuit of the corresponding color (the pulse width correction circuit 608Y, 608M, 608C, or 608K).

As indicated by a dashed line arrow that is diagonally downward from left to right on the middle section in the timing chart of the corresponding color, the pulse width of the image signals of each color (the delayed image signal DY, DM, DC, or DK), which is sequentially input to the pulse width correction circuit of the corresponding color, is expanded by the pulse width correction circuit of the corresponding color, such that the emission duration of the corresponding color is extended by the emission delay duration (a diagonally lined part in the timing chart) on the scanning position of the laser light relating to the image signal of the color (the writing start reference position relating to the image signal of the color).

The expanded image signals of the respective colors (expanded image signals DDY, DDM, DDC, and DDK) are each sequentially input to the LD driver of the corresponding color (the LD driver 101Y, 101M, 101C, or 101K). The semiconductor laser of each color (the semiconductor laser 102Y, 102M, 102C, or 102K) is driven based on the expanded image signal of the corresponding color. As indicated by a dashed line arrow that is diagonally downward from left to right on the lowermost section in the timing chart of the corresponding color, output of laser light of each color is delayed behind input of the expanded image signal of the color by the emission delay duration on the writing start reference position relating to the expanded image signal of the color.

According to the laser driving control in the present embodiment as described above, output of the respective image signals of the Y, M, C, and K colors are each started the duration α prior to elapse of the duration which is necessary for the scanning position of the laser light of the corresponding color to move to the scanning start reference position on the image carrying surface of the photosensitive drum of the corresponding color after the scanning start signal of the color is input to the CPU 601. Then, the image signals of the color are in units of pixels in one clock cycle. As a result, the respective image signals of the Y, M, C, and K colors corresponding to one line in the scanning direction (one scanning line) are each output earlier by the duration α.

Then, the image signal of each color is delayed for cancellation by the emission start position correction circuit of the corresponding color by a duration (a duration α-dyk, α-dmk, α-dck, or α-dkk) that is obtained by subtracting, from the duration α, the emission delay duration (the emission delay duration dyk, dmk, dck, or dkk) on the scanning position of the laser light relating to the image signal of the color (the writing start reference position relating to the image signal of the color). Then, the pulse width of the image signal of the color is expanded by the pulse width correction circuit of the corresponding color, such that the emission duration of the corresponding color is extended by the emission delay duration on the scanning position of the laser light relating to the image signal of the color (the writing start reference position relating to the image signal of the color). The expanded image signal of the color is input to the LD driver of the corresponding color to drive the semiconductor laser of the corresponding color.

As a result, the semiconductor laser of each color is driven in accordance with a timing which is prior to a timing when the scanning position of the laser light of the corresponding color moves to the scanning start reference position relating to the image signal of the corresponding color which is initially output (the image signal instructing to turn on emission) after detection of the scanning start signal of the corresponding color by the emission delay duration on the scanning start reference position. When the emission delay duration has elapsed after driving of the semiconductor laser of the color, that is, when the laser light scanning of the corresponding color moves to the scanning start reference position (the initial writing start reference position in the scanning direction), the semiconductor laser of the color starts emitting laser light.

The same applies to the image signals of the corresponding color which are sequentially output subsequent to the image signal of the corresponding color which has been initially output (the image signal instructing to turn on emission). Specifically, the semiconductor laser of the color is driven in accordance with a timing which is prior to a timing when the scanning position of the laser light of the corresponding color moves to the writing start reference position relating to the image signal of the corresponding color by the emission delay duration on the writing start reference position. When the emission delay duration has elapsed after driving of the semiconductor laser of the color, that is, when the laser light scanning of the corresponding color moves to the writing start reference position, the semiconductor laser of the color starts emitting laser light.

According to the laser driving control in the embodiment as described above, the semiconductor laser of each color is driven in accordance with the timing which is prior to the timing when the scanning position of the laser light of the corresponding color moves to the writing start reference position of the corresponding color by the emission delay duration on the writing start reference position of the corresponding color. Accordingly, it is possible to control the writing start reference position of the laser light in the scanning direction relating to the image signal of each color corresponding to one line in the scanning direction (the image signal instructing to turn on emission) to be the writing start reference position of the corresponding color.

Therefore, by setting the respective writing start reference positions of the Y, M, C, and K colors in the laser light scanning direction in advance so as to coincident with each other on the image carrying surface of the photosensitive drums, it is possible to prevent color misregistration caused by misalignment in image forming start position between the colors in the scanning direction for image formation by layering the images of the colors.

(Modifications)

Up to this point, the present invention has been described by way of the above embodiment. However, it should be naturally appreciated that the present invention is not limited to the above embodiment and various modifications including the following may be made.

In the embodiment, the image signal of each color is output earlier by the duration α, and then control is performed by delaying the image signal by the duration corresponding to the difference between the duration α and the emission delay duration on the scanning position of the laser light relating to the image signal such that emission of laser light from the semiconductor laser is started on the scanning start reference position. Alternatively, control may be performed without using the emission start position correction circuit such that emission of laser light from the semiconductor laser of each color is started on the scanning start reference position as described below.

Figure 14:
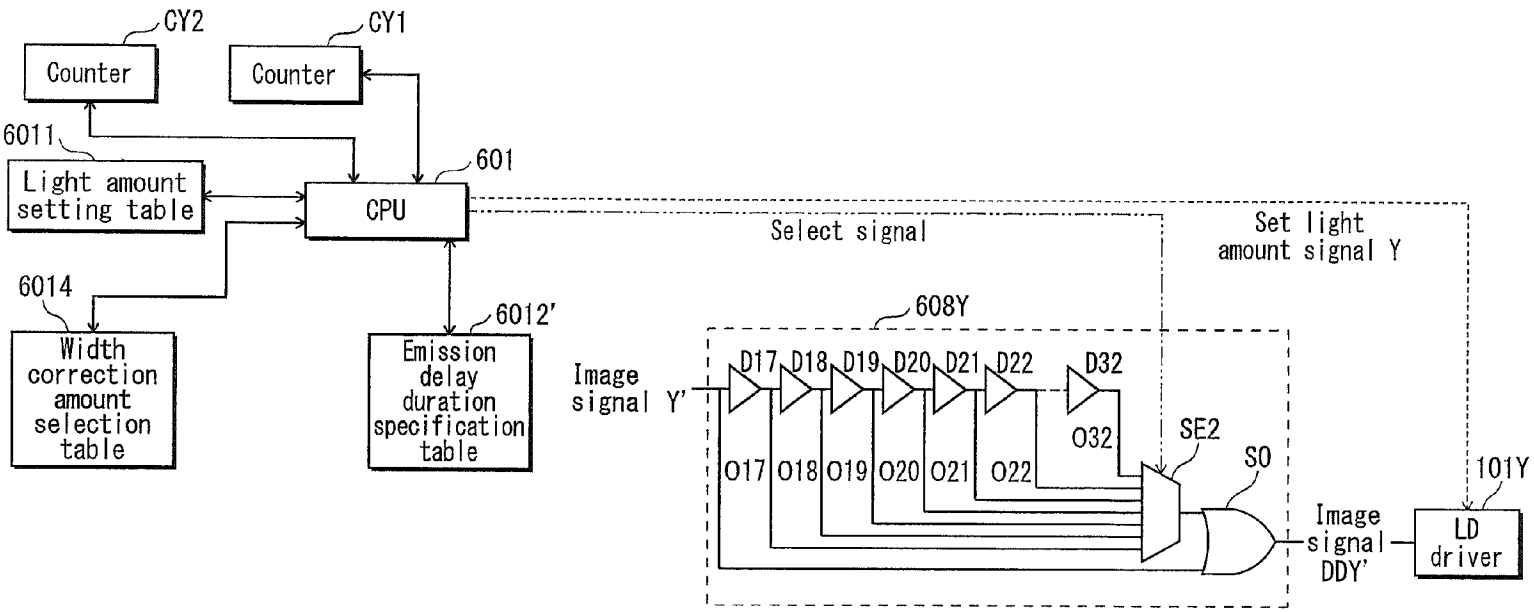
FIG. 14 is a functional block diagram showing major structural elements relating to Y-color laser driving control in a modification.

FIG. 14 is a functional block diagram showing major structural elements relating to Y-color laser driving control in the present modification. As shown in the figure, the present modification differs from the above embodiment in terms of the following points. A control unit of the present modification does not include the emission start position correction circuit 607Y. Also, in the present modification, since there is only a minor difference in emission delay duration between scanning positions in the scanning direction, an emission delay duration specification table is created without consideration for misalignment in image formation position between pixels in the scanning direction due to the minor difference. Other structural elements of the present modification are the same as those of the above embodiment.

Also, an emission delay duration specification table 6012' in the present modification shows a correspondence relationship among (1) a set reference value for exposure intensity of the semiconductor laser used for exposure-scanning of each color, (2) exposure intensity of the semiconductor laser of the corresponding color on each scanning position in the scanning direction of laser light emitted from the semiconductor laser, and (3) an emission delay duration on the scanning position of the laser light in the laser light scanning direction of the semiconductor laser which is the scanning start reference position.

Major structural elements relating to laser driving control of the M, C, and K colors have the same structure as those in FIG. 14. Specifically, instead of the counters CY1 and CY2, the pulse width correction circuit 608Y, and the LD driver 101Y, the major structural elements relating to the M-color laser driving control include counters CM1 and CM2, a pulse width correction circuit 608M, and an LD driver 101M. Similarly, the major structural elements relating to the C-color laser driving control include counters CC1 and CC2, a pulse width correction circuit 608C, and an LD driver 101C. Similarly, the major structural elements relating to the K-color laser driving control include counters CK1 and CK2, a pulse width correction circuit 608K, and an LD driver 101K. Other major structural elements (a CPU 601, a light amount setting table 6011, the emission delay duration specification table 6012', and a width correction amount selection table 6014) are common among the M, C, and K colors.

Figure 15:
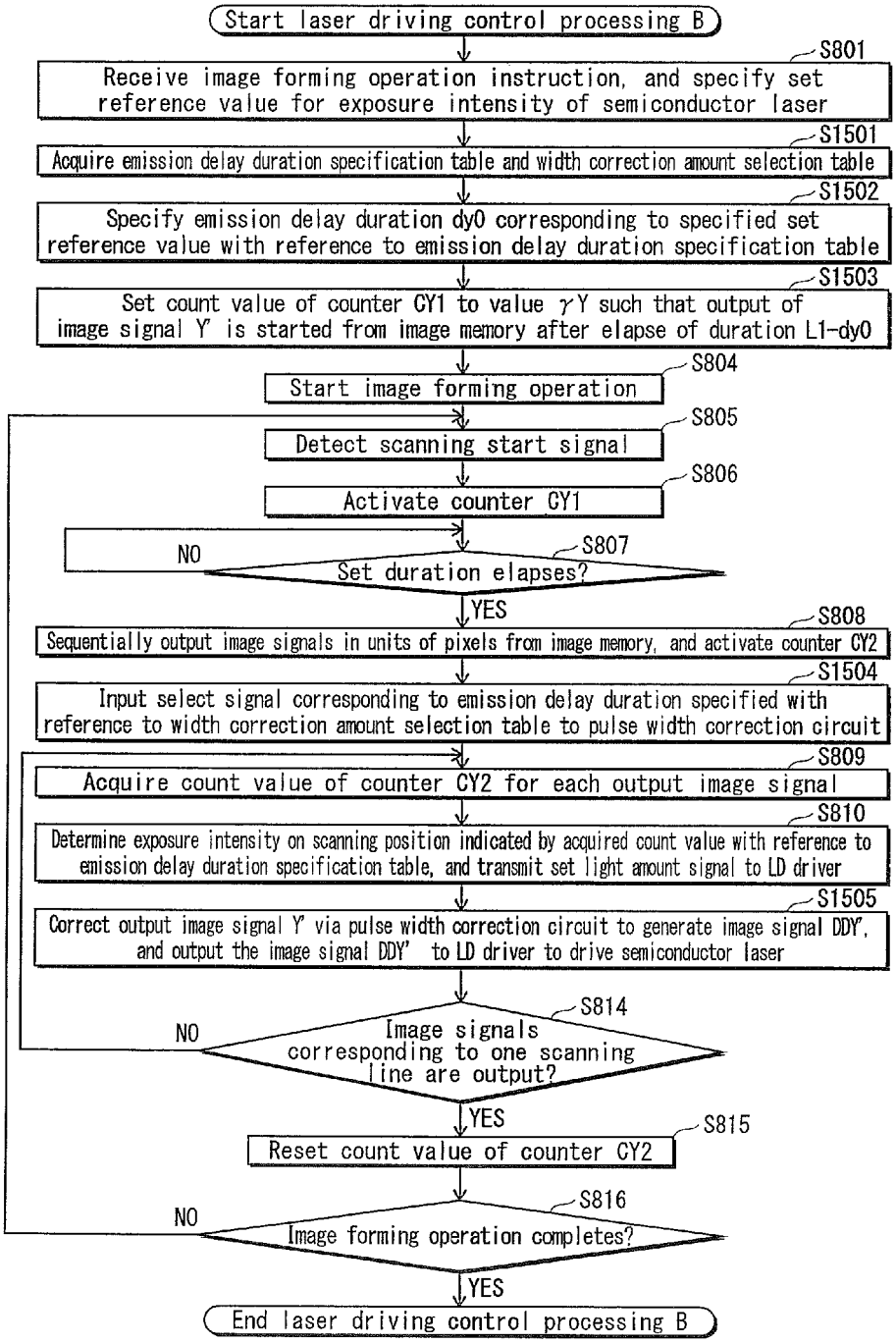
FIG. 15 is a flow chart showing operations of Y-color laser driving control processing B.
Figure 16A:
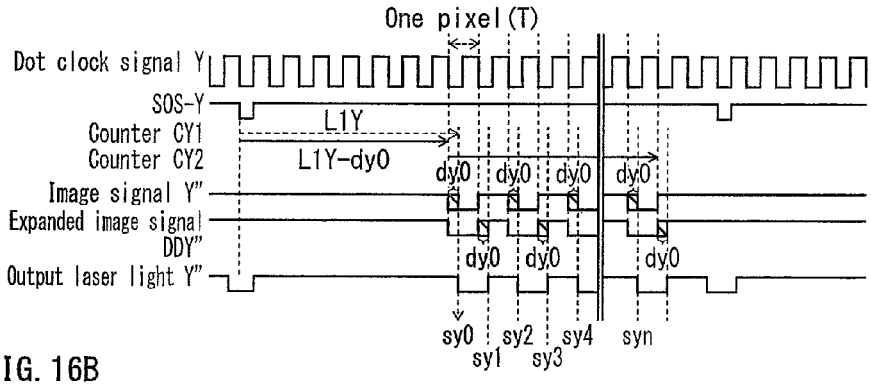
FIG. 16A to FIG. 16D are respective timing charts relating to laser driving control of the Y, M, C, and K colors in a modification.
Figure 16B:
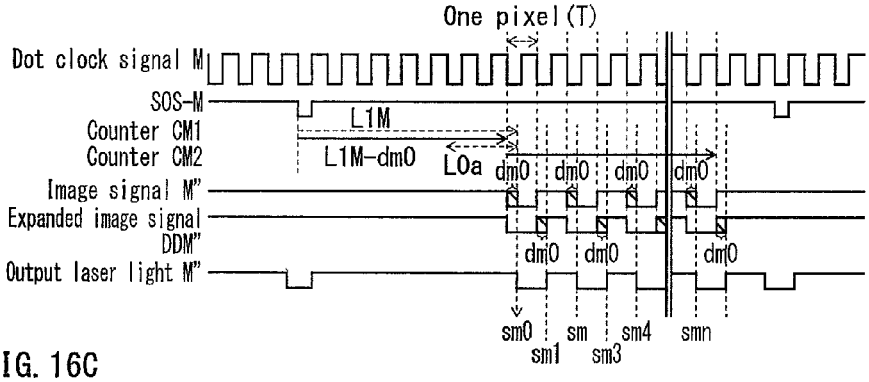
Figure 16C:
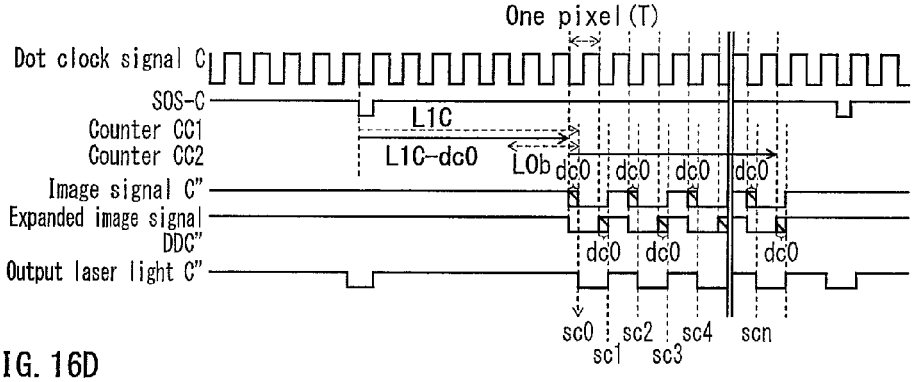
Figure 16D:
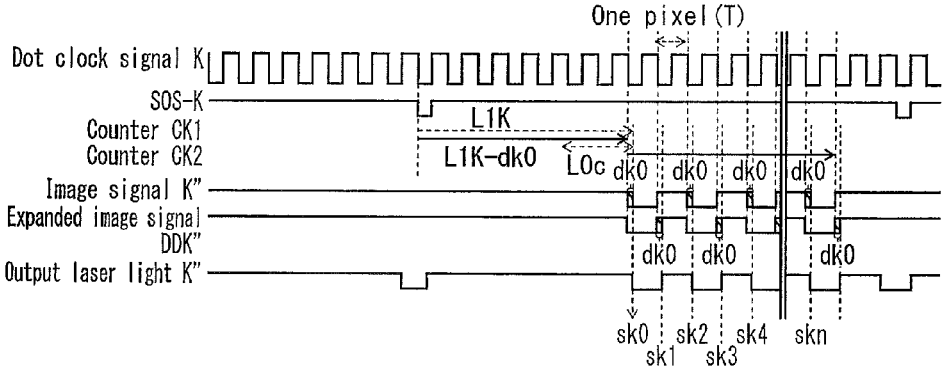

FIG. 15 is a flow chart showing operations of Y-color laser driving control processing B in the present modification. In the figure, the operations that are the same as the operations of the Y-color laser driving control processing A in the embodiment shown in FIG. 8 have the same step numbers and description thereof is omitted. Differences therebetween are mainly described below.

After performing the processing in Step S801, the CPU 601 acquires the emission delay duration specification table 6012' and the width correction amount selection table 6014 from the ROM 603 (Step S1501). With reference to the emission delay duration specification table 6012', the CPU 601 specifies an emission delay duration corresponding to a specified set reference value (an emission delay duration dy0 on a scanning position in the laser light scanning direction which is the scanning start reference position) (Step S1502). Then, the CPU 601 sets the count value of the counter CY1 to a value γY corresponding to a duration L1-dy0 such that output of an image signal of the Y color (an image signal Y') from the image memory 602 is started when the duration L1-dy0 has elapsed after detection of a scanning start signal (Step S1503).

After performing the processing in Steps S804 to S808, the CPU 601 specifies a select signal corresponding to the specified emission delay duration dy0 with reference to the width correction amount selection table 6014, and inputs the specified select signal to the pulse width correction circuit 608Y (Step S1504). Then, the CPU 601 performs the processing in Steps S809 and S810.

The CPU 601 corrects an output image signal Y' via the pulse width correction circuit 608Y to generate an expanded image signal DDY', and controls the expanded image signal DDY' to be output to the LD driver 101Y, and then controls the LD driver 101Y to drive the semiconductor laser 102Y based on the expanded image signal DDY' (Step S1505). Then, the CPU 601 performs the processing in Steps S814 to S816.

When a judgment result in Step S814 is negative (Step S814: NO), the CPU 601 moves onto Step S809. When the judgment result in Step S814 is affirmative (Step S814: YES), the CPU 601 moves onto Step S815.

When a judgment result in Step S816 is negative (Step S816: NO), the CPU 601 moves onto Step S805.

Except the specified set reference value for exposure intensity, the exposure intensity determined for each scanning position, and the emission delay duration corresponding to the set reference value (respective emission delay durations of the M, C, and K are dm0, dc0, and dk0), which differ for each color, laser driving control processing B of the M, C, and K colors is performed similarly to the Y-color laser driving control processing B.

FIG. 16A to FIG. 16D are respective timing charts relating to laser driving control of the Y, M, C, and K colors in the present modification.

In the present modification similarly to the comparative example, the laser driving control of the Y, M, C, and K colors is sequentially started in accordance with a different timing such that toner images that are formed on the respective photosensitive drums of the Y, M, C, and K colors are multi-transferred in layered form on the same position on the intermediate transfer belt 11. The laser driving control of the Y, M, C, and K colors is started in a stated order here.

Also similarly to the comparative example, since the laser driving control of the Y, M, C, and K colors in the present modification is the same except for the different start timing, the timing charts of the laser driving control of the Y, M, C, and K colors are collectively described below.

As shown in FIG. 16A to FIG. 16D, when a scanning start signal output from each of the respective SOS sensors of the Y, M, C, and K colors (the SOS sensors 103Y, 103M, 103C, and 103K) is detected, that is, when scanning start signals SOS-Y, SOS-M, SOS-C, and SOS-K each fall, the respective counters of the Y, M, C, and K colors (the counters CY1, CM1, CC1, and CK1) are each activated by the CPU 601.

When a count value of the counter of each color reaches a corresponding one of respective count values (count values γY, γM, γC, and γK) each corresponding to a duration (a duration L1Y-dy0, L1M-dm0, L1C-dc0, or L1K-dk0) after detection of the scanning start signal of the corresponding color, dot clock signals (dot clock signals Y, M, C, and K) are each output from the dot clock circuit of the corresponding color to the image memory 602. Also, image signals of the colors (image signals Y", M", C", and K") are sequentially output from the image memory 602 in units of pixels (in one clock cycle T here), and another counters of the colors (the counters CY2, CM2, CC2, and CK2) are activated by the CPU 601, and count of dot clock signals that are output to the image memory 602 is started. The durations L1Y-dy0, L1M-dm0, L1C-dc0, and L1K-dk0 are each shorter by the corresponding emission delay duration (the emission delay durations dy0, dm0, dc0, and dk0) than the corresponding duration (the duration L1Y, L1M, L1C, or L1K) which is necessary for a scanning position of laser light of the corresponding color to move to the scanning start reference position of the corresponding color (the scanning start reference position y0, sm0, sc0, or sk0).

As a result, output of the image signal of each color is started prior to elapse of the duration which is necessary for the scanning position of laser light of the corresponding color to move to the scanning start reference position on the image carrying surface of the photosensitive drum of the corresponding color, by the emission delay duration of laser light of the corresponding color (hatched part in the figures).

The respective image signals of the Y, M, C, and K colors, which are sequentially output, are each sequentially input to the pulse width correction circuit of the corresponding color, and the pulse width of the image signal is expanded by the pulse width correction circuit such that an emission duration of laser light of the corresponding color is extended by the emission delay duration of laser light of the corresponding color (hatched part in the figures). The expanded image signals of each color (expanded image signals DDY", DDM", DDC", or DDK") are each sequentially input to the LD driver of the corresponding color. The semiconductor laser of the corresponding color is driven based on the expanded image signal of the corresponding color. Output of laser light of the corresponding color (laser light Y", M", C", and K") is delayed behind input of the expanded image signal (the image signal instructing to turn on emission) of the color by the emission delay duration of laser light of the corresponding color.

According to the laser driving control in the present modification as described above, output of the respective image signals of the Y, M, C, and K colors are each started prior to elapse of the duration which is necessary for the scanning position of the laser light of the corresponding color to move to the scanning start reference position on the image carrying surface of the photosensitive drum of the corresponding color, by the emission delay duration of the laser light of the corresponding color. Then, the pulse width of the image signal of each color is expanded by the pulse width correction circuit of the corresponding color such that the emission duration of laser light of the corresponding color is extended by the emission delay duration of laser light of the corresponding color. The image signal of the color is input to the LD driver of the corresponding color to drive the semiconductor laser of the corresponding color.

As a result, the semiconductor laser of each color is driven in accordance with a timing which is prior to a timing when the scanning position of the laser light of the corresponding color moves to the scanning start reference position (a timing when the duration L1Y, L1M, L1C, or L1K has elapsed after detection of the scanning start signal of the corresponding color), by the emission delay duration of laser light of the corresponding color. When the emission delay duration has elapsed after driving of the semiconductor laser of the color, that is, when the laser light scanning of the corresponding color moves to the scanning start reference position (the initial writing start reference position in the scanning direction), the semiconductor laser of the color starts emitting laser light.

According to the laser driving control in the present modification as described above, the semiconductor laser of each color is driven in accordance with the timing which is prior to the timing when the scanning position of the laser light of the corresponding color moves to the scanning start reference position of the corresponding color, by the emission delay duration on the scanning start reference position of laser light of the corresponding color. Accordingly, it is possible to control the scanning start position of the laser light in the scanning direction of each color to be the scanning start reference position of the corresponding color.

Furthermore, also with respect to the writing start reference position other than the scanning start reference position, the semiconductor laser of each color is driven in accordance with a timing which is prior to the timing when the scanning position of the laser light of the corresponding color moves to the writing start reference position of the corresponding color, by the emission delay duration on the scanning start reference position of laser light of the corresponding color. Accordingly, compared with the comparative example, it is possible to control the writing start position of laser light of the corresponding color in the scanning direction to be close to the writing start reference position of the corresponding color by the emission delay duration on the scanning start reference position.

According to the laser driving control in the present modification on the other hand, an amount of misalignment on each scanning position in the scanning direction is corrected with use of the light emission delay duration on the scanning start reference position. Accordingly, although the laser driving control in the present modification is slightly more inferior than the laser driving control in the embodiment in terms of precision in correction of the amount of misalignment on the writing start reference position in the scanning direction other than the scanning start reference position, the laser driving control in the present modification controls the scanning start position of laser light in the scanning direction to be the scanning start reference position with a simpler structure than the laser driving control in the embodiment.

Therefore, by setting the respective scanning start reference positions of the Y, M, C, and K colors in advance so as to coincident with each other on the image carrying surface of the photosensitive drums in the laser light scanning direction, it is possible to prevent color misregistration caused by misalignment in image forming start position between the colors in the scanning direction for image formation by layering the images of the colors.

(2) In the modification (1), the scanning start position is controlled for each scanning line. The emission delay duration of laser light does not vary between the scanning lines according to the normal image forming condition. However, in the case where an internal temperature of the printer 1 varies during an image forming operation (for example, in the case where processing of printing a large amount of sheets is continuously performed), temperature of the semiconductor laser varies depending on a timing to form the scanning line, and the emission delay duration of the laser light varies due to the temperature variation. That is, as the temperature of the semiconductor laser increases, the emission delay duration increases.

For this reason, a table may be created beforehand using the printer by making tests, which shows a correspondence relationship among the set reference value for exposure intensity of the semiconductor laser, the exposure intensity of the semiconductor laser on each scanning position in the scanning direction of laser light emitted from the semiconductor laser, the internal temperature, and the emission delay duration on the scanning position in the laser light scanning direction which is the scanning start reference position. This table may be stored in the ROM 603 as an emission delay duration specification table 6012", and an internal temperature sensor for detecting the internal temperature may be provided in the printer 1. The operations of the Y-color laser driving control processing B shown in FIG. 15 may be further modified as shown in FIG. 17.

Figure 17:
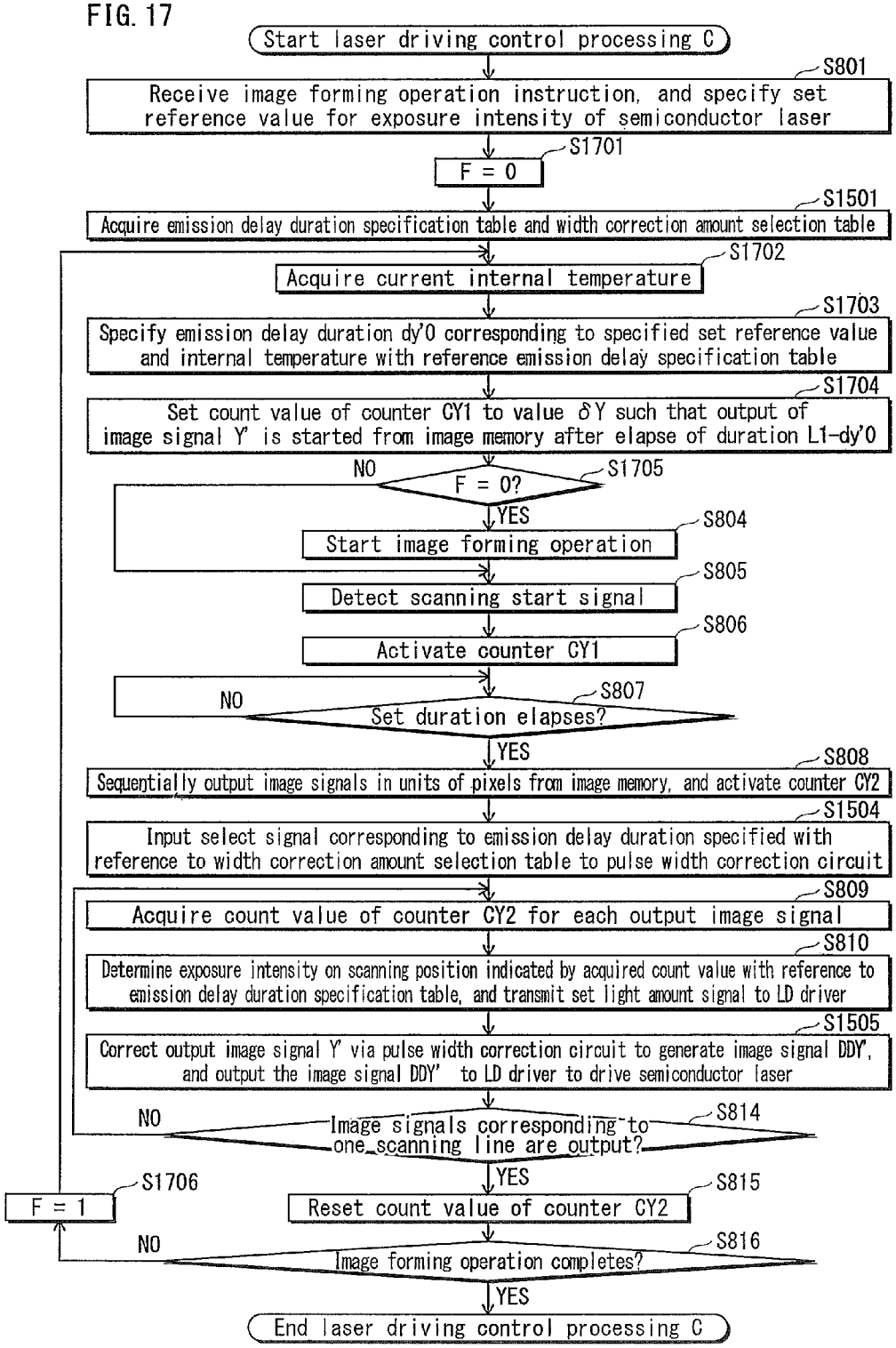
FIG. 17 is a flow chart showing operations of Y-color laser driving control processing C.

In Y-color laser driving control processing in FIG. 17, operations that are the same as the operations of the Y-color laser driving control processing B shown in FIG. 15 have the same step numbers and description thereof is omitted. Differences therebetween are mainly described below. After performing the processing in Step S801, the CPU 601 initializes a flag value F indicating whether an image forming operation has been started to zero (Step S1701). After performing the processing in Step S1501 (the emission delay duration specification table 6012" is acquired instead of the emission delay duration specification table 6012'), the CPU 601 acquires a current internal temperature from the internal temperature sensor (Step S1702), and specifies an emission delay duration corresponding to the specified set reference value and the acquired internal temperature (an emission delay duration dy'0 on a scanning position of laser light in the scanning direction which is the scanning start reference position) with reference to the emission delay duration specification table 6012" (Step S1703). Then, the CPU 601 sets the counter value of the counter CY1 to a value δY corresponding to a duration L1-dy'0 such that output of an image signal of the Y-color (an image signal Y') from the image memory 602 is started when the duration L1-dy'0 has elapsed after detection of the scanning start signal (Step S1704).

Furthermore, the CPU 601 judges whether the flag value F is zero (Step S1705). When the flag value F is zero (Step S1705: YES), the CPU 601 moves onto Step S804. When the flag value F is not zero (Step S1705: NO), the CPU 601 moves onto Step S805.

Then, the CPU 601 performs the processing in Steps S806 to S808, S1504 (the emission delay duration dy'0 is used here instead of the emission delay duration dy0), S809, S810, S1505, S814 to S816. When the image forming operation does not complete (Step S816: NO), the CPU 601 sets the flag value F to one (Step S1706), and then moves onto Step S1702.

Except the specified set reference value for exposure intensity, the exposure intensity determined for each scanning position, and the emission delay duration corresponding to the set reference value and the internal temperature, which differ for each color, laser driving control processing C of the M, C, and K colors is performed similarly to the Y-color laser driving control processing C.

(3) By performing image stabilization processing instead of implementing the embodiment and the modifications (1) and (2), it is also possible to prevent misalignment in image forming start position in the scanning direction between the colors, thereby preventing color misregistration for image formation by layering the images of the colors.

Here, the image stabilization processing is processing that is performed in accordance with a predetermined timing in order to stabilize the quality of images output from the printer 1 such as concentration and hue of the images. The predetermined timing is for example a timing when the power is on, the printer 1 is restored from a sleep state, and when a component is replaced. In the image stabilization processing, a reference pattern image is formed under a predetermined image forming condition, and the toner concentration or the like of the reference pattern image is measured. As a result, an image forming condition is determined such as exposure intensity of the semiconductor laser of each color, voltage for charging the photosensitive drum of each color, and developing bias voltage to be applied to the developer of each color.

Image forming processing cannot be performed while the image stabilization processing is performed. For this reason, if the image stabilization processing is frequently performed, the productivity of image forming processing decreases, and this is inconvenient.

Accordingly, it is effective to perform the operations of the laser driving control processing in each of the embodiment and the modifications (1) and (2) as described below after the image stabilization processing completes, particularly in terms of that prevention of the decrease in the productivity of the image forming processing and stabilization of the image quality are both realized.

Figure 18:
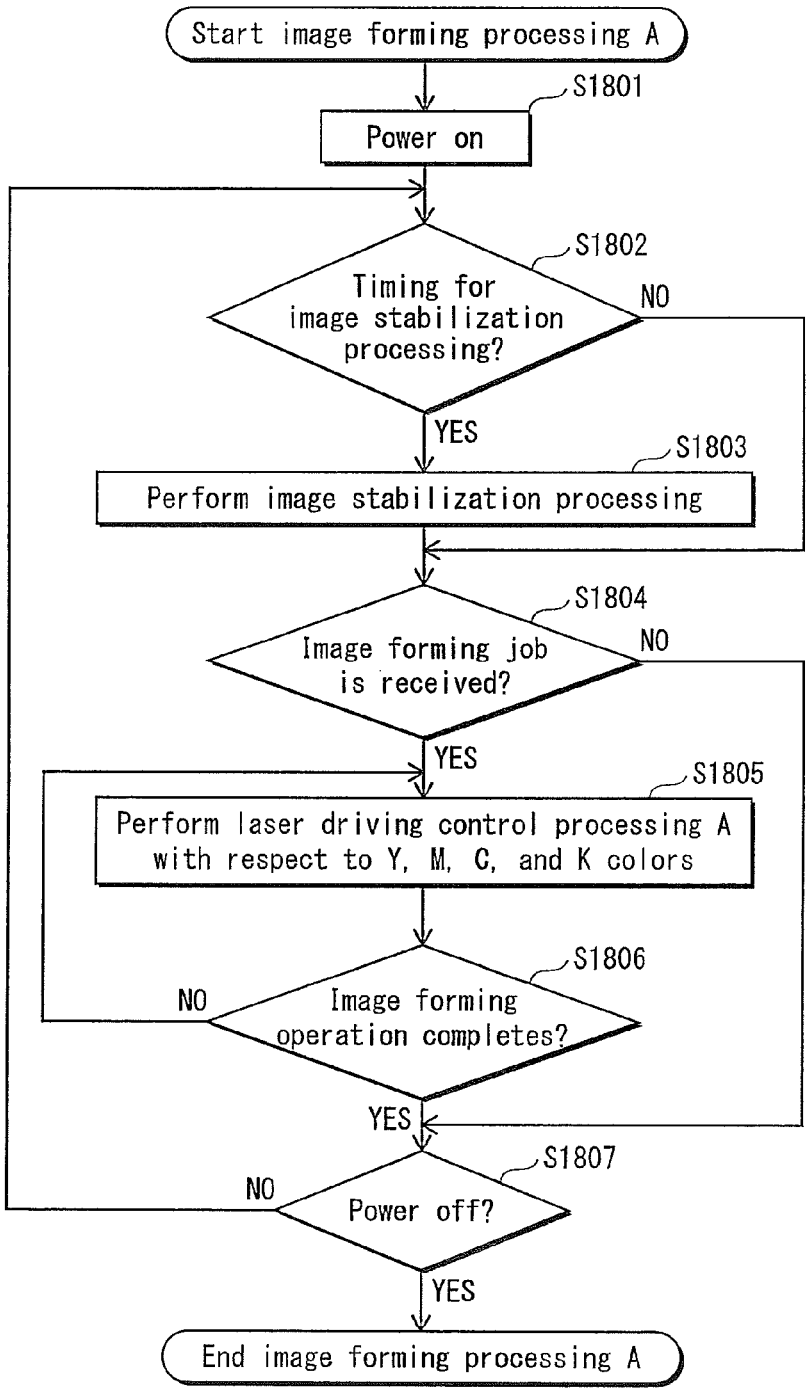
FIG. 18 is a flow chart showing operations of image forming processing A to which the laser driving control processing A is applied.

FIG. 18 is a flow chart showing operations of image forming processing A to which the laser driving control processing A in the embodiment is applied. The power of the printer 1 is on (Step S1801). When a timing to perform image stabilization processing has come (Step S1802: YES), the CPU 601 performs the image stabilization processing to determine an image forming condition (Step S1803). Then, each time receiving an image forming job (Step S1804: YES), the CPU 601 performs the laser driving control processing A for each of the Y, M, C, and K colors to perform an image forming operation relating to the image forming job (Step S1805). When the image forming operation completes (Step S1806: YES) and when the power of the printer 1 is on (S1807: NO), the CPU 601 moves onto Step S1802.

Figure 19:
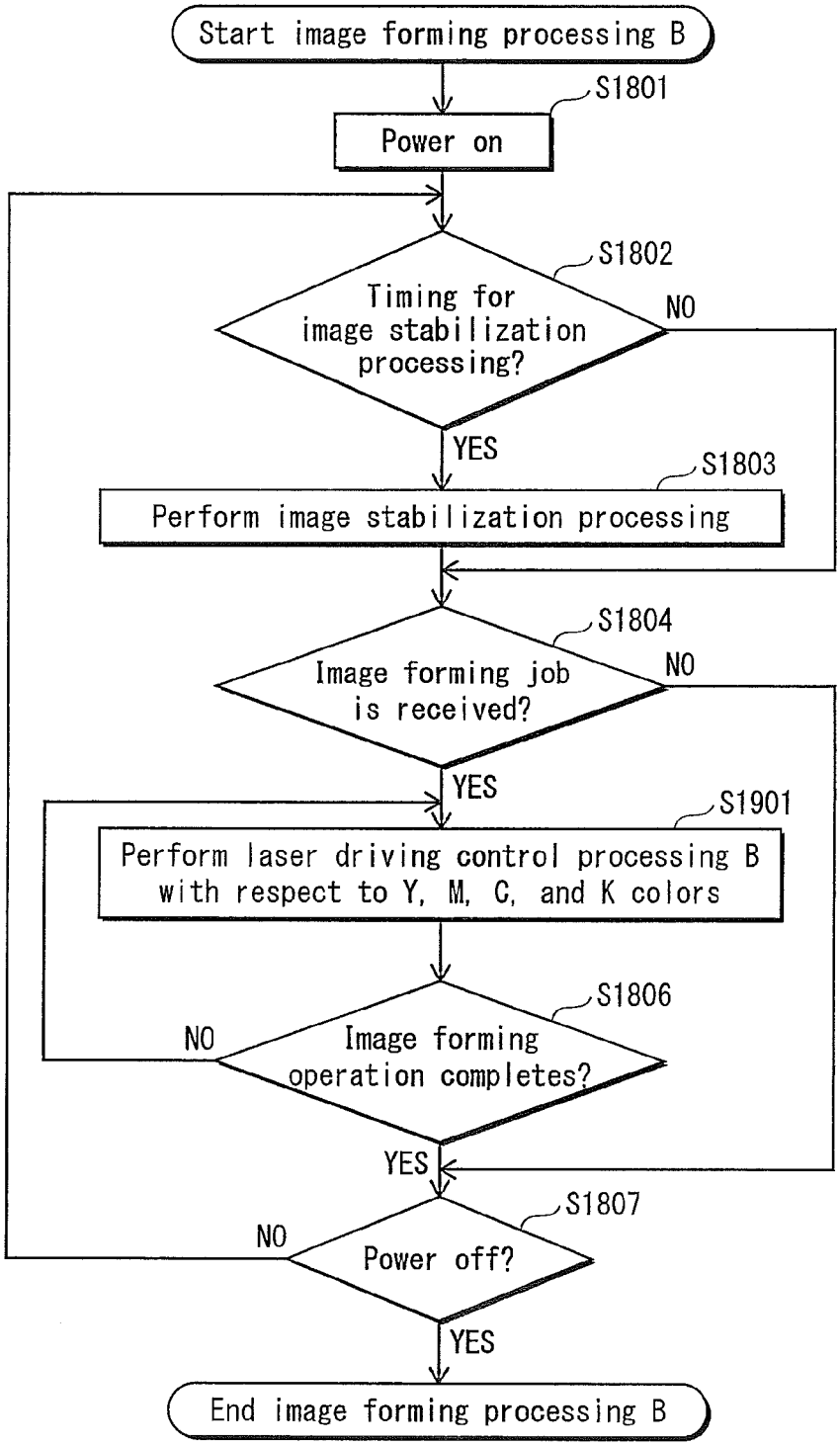
FIG. 19 is a flow chart showing operations of image forming processing B to which the laser driving control processing B is applied.

FIG. 19 is a flow chart showing operations of image forming processing B to which the laser driving control processing B in the modification (1) is applied. In the figure, the operations that are the same as the operations of the image forming processing shown in FIG. 18 have the same step numbers and description thereof is omitted. Differences therebetween are described below.

The image forming processing B to which the laser driving control processing B in the modification (1) is applied differs from the image forming processing shown in FIG. 18 in terms of the following point. When an image forming job is received in Step S1804 (Step S1804: YES), the CPU 601 performs the laser driving control processing B for each of the Y, M, C, and K colors (Step S1901).

Figure 20:
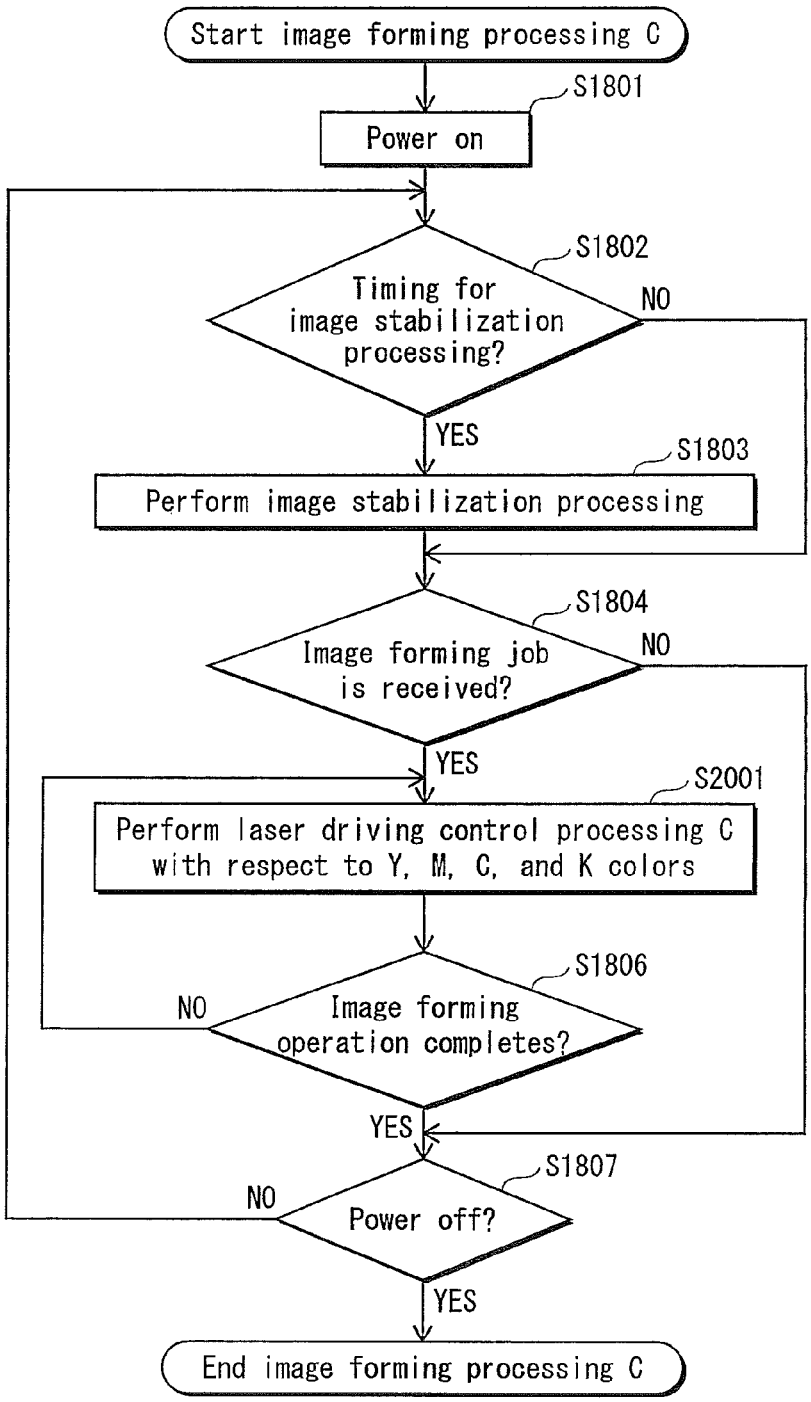
FIG. 20 is a flow chart showing operations of image forming processing C to which the laser driving control processing C is applied.
Figure 21:
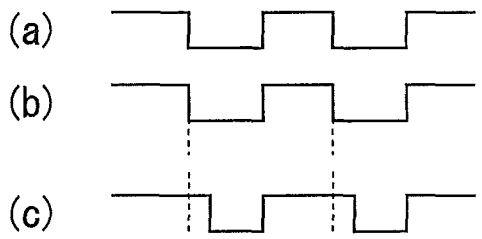
FIG. 21 Prior Art
FIG. 21 is a timing chart showing a correspondence relationship among an image signal input to a laser driving device, driving current supplied to a semiconductor laser in accordance with the input image signal, and output of laser light emitted from the semiconductor laser in accordance with the supplied driving current.

FIG. 20 is a flow chart showing operations of image forming processing C to which the laser driving control processing C in the modification (2) is applied. In the figure, the operations that are the same as the operations of the image forming processing shown in FIG. 18 have the same step numbers and description thereof is omitted. Differences therebetween are described below.

The image forming processing C to which the laser driving control processing C in the modification (2) is applied differs from the image forming processing shown in FIG. 18 in terms of the following point. When an image forming job is received in Step S1804 (Step S1804: YES), the CPU 601 performs laser driving control processing C with respect to each of the Y, M, C, and K colors (Step S2001).

With this structure, even in the case where, after the image stabilization processing is performed, an image forming job at exposure intensity that is different from the exposure intensity of the semiconductor laser is received due to the change of the image forming condition such as the change of the resolution and the sheet type, it is possible to prevent misalignment in image forming start position in the scanning direction between the colors to prevent color misregistration for image formation by layering images of the colors, without performing new image stabilization processing in addition to the image stabilization processing performed in accordance with the predetermined timing. As a result, prevention of the decrease in the productivity of the image forming processing and stabilization of the image quality are both realized.

Also, according to the laser driving control in the embodiment and the modifications (1) and (2), the scanning start position is controlled for each scanning line to be the scanning start reference position irrespective of variation in exposure intensity of the semiconductor laser. Accordingly, even in the case where the exposure intensity of the semiconductor laser is changed during an image forming operation after image stabilization processing is performed (for example, in the case where an amount of laser light is changed between front sides and back sided for double-side printing), it is possible to control the scanning start position of laser light not to misalign from the scanning start reference position. This prevents misalignment in image forming start position in the scanning position between the colors, thereby preventing color misregistration for image formation by layering images of the colors.

As a result, even in this case, prevention of the decrease in the productivity of the image forming processing and stabilization of the image quality are both realized.

SUMMARY

An image forming apparatus relating to one aspect of the present invention that has been disclosed above is an image forming apparatus that forms a color image by layering toner images of different colors, the image forming apparatus comprising: a photoreceptor on which an electrostatic latent image is formed through charging and exposure; an exposure unit that performs exposure-scanning on a surface of the photoreceptor in accordance with an image signal input thereto; an intensity determination unit that determines exposure intensity of the exposure unit according to an image forming condition; and a timing determination unit that determines an input timing at which an image signal is to be input to the exposure unit for each scanning line, wherein the exposure unit has a delay duration that differs depending on the exposure intensity, the delay duration being a duration from input of an image signal of each pixel to be exposed in each scanning line on the surface of the photoreceptor to start of exposure of the pixel at the determined exposure intensity, and the timing determination unit obtains the delay duration corresponding to the determined exposure intensity, and determines the input timing such that an image signal of an initial pixel to be initially exposed in each scanning line on the surface of the photoreceptor is input the delay duration before exposure of the initial pixel is started.

With this structure, the input timing is determined such that the image signal of the initial pixel to be initially exposed in each scanning line on the surface of the photoreceptor is input the delay duration before exposure of the initial pixel is started. Accordingly, the initial pixel is exposed at the exposure intensity determined according to the image forming condition, without being influenced by the delay duration.

As a result, it is possible to reduce variation in writing start position in the scanning direction for exposure-scanning which is caused by variation in delay duration between the colors. This prevents color misregistration due to misalignment in image forming start position in the scanning direction between the colors for image formation by layering images of the colors.

Here, the image forming apparatus may further comprise an output unit that outputs image signals based on print image data for each scanning line in accordance with an output instruction, wherein the timing determination unit may include: a detection unit that detects a scanning start signal instructing to start exposure-scanning on each scanning line; an output instruction unit that issues the output instruction to the output unit after the scanning start signal is detected; and a pulse width correction unit that expands a pulse width of an image signal of each pixel to be exposed among the output image signals by a pulse width corresponding to the delay duration to generate an image signal to be input to the exposure unit, wherein the exposure unit may extend an exposure duration by the delay duration in accordance with the generated image signal.

Also, the output instruction unit may issue the output instruction the delay duration before exposure of the initial pixel in the scanning line is started.

With this structure, an exposure duration of the exposure unit is extended by the delay duration. Accordingly, the exposure unit performs exposure for the exposure duration in accordance with the image signal, and therefore it is possible to precisely form an image in accordance with an image signal for each color.

Here, the intensity determination unit may determine the exposure intensity for each scanning position in a scanning direction, the timing determination unit may obtain a delay duration on each scanning position corresponding to the exposure intensity determined for the scanning position, the pulse width correction unit may expand a pulse width of an image signal of each pixel to be exposed by a pulse width corresponding to the delay duration on the scanning position of the pixel to generate an image signal to be input to the exposure unit, and the timing determination unit may determine the input timing such that an image signal of each pixel to be exposed in each scanning line on the surface of the photoreceptor is input before exposure of the pixel is started by the delay duration obtained for the scanning position of the pixel.

Also, the output instruction unit may issue the output instruction a predetermined duration before exposure of the initial pixel is started, and the timing determination unit may include: a delay unit that delays a timing to input the image signals that are output in accordance with the output instruction to the pulse width correction unit; and a delay amount determination unit that determines a delay amount of the timing delayed by the delay unit such that an image signal of each pixel to be exposed among the output image signals is input to the pulse width correction unit before exposure of the pixel is started by the delay duration obtained for the scanning position of the pixel.

With these structures, the exposure intensity is determined for each scanning position in the scanning direction, the delay duration corresponding to the determined exposure intensity is obtained for the scanning position, and the pulse width of the image signal of each pixel to be exposed is expanded by a pulse width corresponding to the delay duration on the scanning position of the pixel to generate an image signal to be input to the exposure unit. Accordingly, even in the case where the exposure intensity differs for each scanning position, the exposure unit performs exposure on the scanning position for the exposure duration in accordance with the image signal. Therefore, it is possible to precisely form an image on each scanning position in accordance with an image signal for each color.

Also, the input timing is determined such that an image signal of each pixel to be exposed in each scanning line on the surface of the photoreceptor is input before exposure of the pixel is started by the delay duration obtained for the scanning position of the pixel. Accordingly, even in the case where the exposure intensity differs for each scanning position, the pixel is exposed at the exposure intensity determined for the scanning position, without being influenced by the delay duration.

As a result, it is possible to prevent variation in writing start position of a scanning position of each pixel to be exposed between the colors due to variation in delay duration on the scanning position. This prevents color misregistration due to misalignment in image forming start position on the scanning position of each pixel to be exposed between the colors for image formation by layering images of the colors.

Here, the delay duration may differ further depending on an internal temperature of the image forming apparatus, the image forming apparatus may further comprise a temperature acquisition unit that acquires the internal temperature for each scanning line, and the timing determination unit may obtain the delay duration further corresponding to the acquired internal temperature.

With this structure, the internal temperature is acquired for each scanning line during an image forming operation, and the input timing is determined such that the image signal of the initial pixel to be initially exposed in each scanning line on the surface of the photoreceptor is input before exposure of the initial pixel is started by the delay duration, which corresponds to the exposure intensity determined according to the image forming condition and the acquired internal temperature. Accordingly, even in the case where the delay duration varies due to variation in the internal temperature during the image forming operation, it is possible to prevent variation in writing start position between the colors, thereby preventing color misregistration due to misalignment in image forming start position in the scanning direction between the colors for forming a color image by layering images of the colors.

Here, the image forming apparatus may perform image stabilization processing in accordance with a predetermined timing, and between completion of preceding image stabilization processing and start of succeeding image stabilization processing, the timing determination unit may obtain the delay duration and determines the input timing.

With this structure, between completion of preceding image stabilization processing and start of succeeding image stabilization processing, the input timing is determined such that the image signal of the initial pixel to be initially exposed in each scanning line on the surface of the photoreceptor is input before exposure of the initial pixel is started by the delay duration, which corresponds to the exposure intensity determined according to the image forming condition. Accordingly, even in the case where the exposure intensity for an image forming condition varies after image stabilization processing, it is possible to prevent, without performing new image stabilization processing, color misregistration due to misalignment in image forming start position in the scanning direction between the colors for forming a color image by layering images of the colors. This prevents decrease in the productivity of image formation.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An image forming apparatus that forms a color image by layering toner images of different colors, the image forming apparatus comprising:

a photoreceptor on which an electrostatic latent image is formed through charging and exposure;

an exposure unit that performs exposure-scanning on a surface of the photoreceptor in accordance with an image signal input thereto;

an intensity determination unit that determines exposure intensity of the exposure unit according to an image forming condition; and a timing determination unit that determines an input timing at which an image signal is to be input to the exposure unit for each scanning line, wherein the exposure unit has a delay duration that differs depending on the exposure intensity, the delay duration being a duration from input of an image signal of each pixel to be exposed in each scanning line on the surface of the photoreceptor to start of exposure of the pixel at the determined exposure intensity, and the timing determination unit obtains the delay duration corresponding to the determined exposure intensity, and determines the input timing such that input of an image signal of an initial pixel to be initially exposed in each scanning line on the surface of the photoreceptor is delayed by a predetermined time before exposure of the initial pixel is started, the predetermined time being based on a scanning start position and a light emission delay duration.

2. The image forming apparatus of claim 1, further comprising an output unit that outputs image signals based on print image data for each scanning line in accordance with an output instruction, wherein the timing determination unit includes:

a detection unit that detects a scanning start signal instructing to start exposure-scanning on each scanning line;

an output instruction unit that issues the output instruction to the output unit after the scanning start signal is detected; and a pulse width correction unit that expands a pulse width of an image signal of each pixel to be exposed among the output image signals by a pulse width corresponding to the delay duration to generate an image signal to be input to the exposure unit, wherein the exposure unit extends an exposure duration by the delay duration in accordance with the generated image signal.

3. The image forming apparatus of claim 2, wherein the intensity determination unit determines the exposure intensity for each scanning position in a scanning direction, the timing determination unit obtains a delay duration on each scanning position corresponding to the exposure intensity determined for the scanning position, the pulse width correction unit expands a pulse width of an image signal of each pixel to be exposed by a pulse width corresponding to the delay duration on the scanning position of the pixel to generate an image signal to be input to the exposure unit, and the timing determination unit determines the input timing such that an image signal of each pixel to be exposed in each scanning line on the surface of the photoreceptor is input before exposure of the pixel is started by the delay duration obtained for the scanning position of the pixel.

4. The image forming apparatus of claim 3, wherein the output instruction unit issues the output instruction a predetermined duration before exposure of the initial pixel is started, and the timing determination unit includes:

a delay unit that delays a timing to input the image signals that are output in accordance with the output instruction to the pulse width correction unit; and a delay amount determination unit that determines a delay amount of the timing delayed by the delay unit such that an image signal of each pixel to be exposed among the output image signals is input to the pulse width correction unit before exposure of the pixel is started by the delay duration obtained for the scanning position of the pixel.

5. The image forming apparatus of claim 2, wherein the output instruction unit issues the output instruction the delay duration before exposure of the initial pixel in the scanning line is started.

6. The image forming apparatus of claim 1, wherein the delay duration differs further depending on an internal temperature of the image forming apparatus, the image forming apparatus further comprises a temperature acquisition unit that acquires the internal temperature for each scanning line, and the timing determination unit obtains the delay duration further corresponding to the acquired internal temperature.

7. The image forming apparatus of claim 1, wherein the image forming apparatus performs image stabilization processing in accordance with a predetermined timing, and between completion of preceding image stabilization processing and start of succeeding image stabilization processing, the timing determination unit obtains the delay duration and determines the input timing.

* * * * *